US009928804B2

(12) United States Patent
Kim et al.

(10) Patent No.: US 9,928,804 B2
(45) Date of Patent: Mar. 27, 2018

(54) ORGANIC LIGHT EMITTING DISPLAY DEVICE WITH FIRST AND SECOND BLUE SUB-PIXELS

(71) Applicant: Samsung Display Co., Ltd., Yongin (KR)

(72) Inventors: Il Nam Kim, Hwaseong-si (KR); Rang Kyun Mok, Seoul (KR); Jong In Baek, Suwon-si (KR); Yi Joon Ahn, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 362 days.

(21) Appl. No.: 14/692,143

(22) Filed: Apr. 21, 2015

(65) Prior Publication Data

US 2016/0189670 A1 Jun. 30, 2016

(30) Foreign Application Priority Data

Dec. 29, 2014 (KR) ..... 10-2014-0192029

(51) Int. Cl.

| | |
|---|---|
| ***G09G 5/02*** | (2006.01) |
| ***G09G 3/20*** | (2006.01) |
| ***G09G 3/3208*** | (2016.01) |

(52) U.S. Cl.

CPC ..... *G09G 5/02* (2013.01); *G09G 3/2003* (2013.01); *G09G 3/3208* (2013.01); (Continued)

(58) Field of Classification Search

CPC ..... G09G 3/2003; G09G 3/32; G09G 3/3208; G09G 3/3275; G09G 3/3291; G09G 5/02; (Continued)

(56) References Cited

U.S. PATENT DOCUMENTS

| | | | | |
|---|---|---|---|---|
| 9,583,044 | B2 * | 2/2017 | Kim, II | G09G 3/3291 |
| 9,672,767 | B2 * | 6/2017 | Kim, II | G09G 3/2074 |

(Continued)

FOREIGN PATENT DOCUMENTS

| | | |
|---|---|---|
| KR | 10-2010-0119653 | 11/2010 |
| KR | 10-2011-0057234 | 5/2011 |

(Continued)

*Primary Examiner* — Keith Crawley

(74) *Attorney, Agent, or Firm* — H.C. Park & Associates, PLC

(57) ABSTRACT

An organic light emitting display device, including a display panel including red, green, first blue, and second blue sub-pixels, a data drive unit configured to receive an image signal and output data output signals, a de-multiplexer circuit configured to distribute data output signals to the data lines connected to the red, green, and the first blue sub-pixels, in response to receiving a first blue drive selection signal, or to the data lines connected to the red, green, first blue, and the second blue sub-pixels, in response to receiving a mixed drive selection signal, and a control unit configured to process a raw image data into the image signal, provide the image signal to the data drive unit, and provide the first blue drive selection signal or the mixed drive selection signal to the de-multiplexer circuit in a frame unit of the raw image data.

20 Claims, 17 Drawing Sheets

(52) U.S. Cl.
CPC . *G09G 2300/0452* (2013.01); *G09G 2310/08* (2013.01); *G09G 2320/0673* (2013.01); *G09G 2340/06* (2013.01); *G09G 2360/18* (2013.01)

(58) Field of Classification Search
CPC .. G09G 5/026; G09G 5/04; G09G 2300/0452; G09G 2300/0804; G09G 2310/0297; G09G 2310/08; G09G 2320/043; G09G 2320/0666; G09G 2320/0673; G09G 2340/06; G09G 2360/18; H01L 27/3213; H01L 27/3216; H01L 27/3218
See application file for complete search history.

(56) References Cited

U.S. PATENT DOCUMENTS

2004/0178974 A1* 9/2004 Miller ..... G09G 3/3216 345/82
2005/0259052 A1* 11/2005 Shin ..... G09G 3/325 345/77
2007/0222800 A1* 9/2007 Fish ..... G09G 3/3233 345/694
2011/0115998 A1 5/2011 Liao et al.
2012/0105517 A1* 5/2012 Yang ..... G09G 3/003 345/694
2012/0147065 A1* 6/2012 Byun ..... G09G 3/3208 345/690
2013/0070006 A1* 3/2013 Yang ..... G09G 3/3225 345/694
2015/0009194 A1 1/2015 Kim et al.
2015/0009242 A1* 1/2015 Park ..... G09G 3/3233 345/690
2015/0248855 A1 9/2015 Kim
2015/0332628 A1* 11/2015 Ren ..... G09G 3/3258 345/690
2016/0189671 A1 6/2016 Kim et al.
2016/0247441 A1* 8/2016 Matsueda ..... G09G 3/2003

FOREIGN PATENT DOCUMENTS

KR 10-2013-0034740 4/2013
KR 10-2015-0006144 1/2015
KR 10-2015-0103785 9/2015
KR 10-2016-0082784 7/2016
WO 2010/039938 4/2010

* cited by examiner

FIG. 9

| CLASSIFICATION | FIRST BLUE DRIVE MODE FRAME | MIXED DRIVE MODE FRAME | SECOND BLUE DRIVE MODE FRAME |
|---|---|---|---|
| P1 | 0 | 1 | 1 |
| P2 | 3 | 1 | 0 |
| P3 | 1 | 0 | 0 |

ORGANIC LIGHT EMITTING DISPLAY DEVICE WITH FIRST AND SECOND BLUE SUB-PIXELS

CROSS-REFERENCE TO RELATED APPLICATION

This application claims priority from and the benefit of Korean Patent Application No. 10-2014-0192029, filed on Dec. 29, 2014, which is hereby incorporated by reference for all purposes as if fully set forth herein.

BACKGROUND

Field

Exemplary embodiments of the present invention relate to an organic light emitting display device. More particularly, the exemplary embodiments of the present invention relate to an organic light emitting display device with improved display quality.

Discussion of the Background

Flat panel display devices, such as a liquid crystal display device or an organic electroluminescence display device, are replacing cathode ray tube display devices in response to recent demands for a reduced weight and thickness of a monitor, a television, a portable display device, or the like. Since an organic light emitting display device may have a high response speed, a low power consumption, and wide viewing angles characteristics among the flat panel display devices, the organic light emitting display device is may be considered as a next generation flat panel display device.

The organic light emitting display device may include an organic light emitting material corresponding to red, green, and blue light. Such organic light emitting material may degrade as the usage time increases, which may be a factor that determines the useful life of the organic light emitting display device.

In general, among the organic light emitting materials, the useful life of a blue-color organic light emitting material may be relatively short as compared to the organic light emitting materials of other colors. Moreover, among the blue-color organic light emitting materials, a sky blue-color organic light emitting material may have a longer useful life than a deep blue-color organic light emitting material. Since the sky blue-color organic light emitting material may have higher energy efficiency compared to the deep blue-color organic light emitting material, utilizing the sky blue-color organic light emitting material may reduce power consumption of the organic light emitting display device. However, the sky blue-color organic light emitting material may have inferior color reproducibility than the deep blue-color, which may render expressing rich and natural color difficult.

In addition, although the organic light emitting display device using the deep blue-color organic light emitting material may have improved color reproducibility and display quality, there may be a difficulty in improving energy efficiency and useful life of the display device.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide an organic light emitting display device with an improved display quality and increased usage life.

Additional aspects will be set forth in the detailed description which follows, and, in part, will be apparent from the disclosure, or may be learned by practice of the inventive concept.

According to an exemplary embodiment of the present invention, an organic light emitting display device includes a display panel including red sub-pixels, green sub-pixels, first blue sub-pixels, and second blue sub-pixels, each sub-pixel connected to scan lines and data lines, a scan drive unit configured to sequentially apply scan signals to the scan lines, a data drive unit configured to receive an image signal and output data output signals, a de-multiplexer circuit configured to distribute data output signals to the data lines connected to the red sub-pixels, the green sub-pixels, and the first blue sub-pixels, in response to receiving a first blue drive selection signal, or distribute the data output signals to the data lines connected to the red sub-pixels, the green sub-pixels, the first blue sub-pixels, and the second blue sub-pixels, in response to receiving a mixed drive selection signal, and a control unit configured to process a raw image data into the image signal, provide the image signal to the data drive unit, and provide the first blue drive selection signal or the mixed drive selection signal to the de-multiplexer circuit in a frame unit of the raw image data, in which the control unit is configured to detect an image data that corresponds to a first color gamut and a second color gamut from the raw image data, and adjust a ratio of a number of frames operating in a first blue drive mode that provides the first blue drive selection signal to the de-multiplexer circuit and a number of frames operating in a mixed drive mode that provides the mixed drive selection signal, based on the image data corresponding to the second color gamut.

According to exemplary embodiments of the present invention, by distinguishing a frame into an area in which a first blue sub-pixel emits sky blue light and an area in which a second blue sub-pixel emits deep blue light, an organic light emitting display device according to the exemplary embodiments of the present invention may have high energy efficiency, long usage life, and improved color reproducibility.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept and are incorporated in and constitute a part of this specification, illustrate exemplary embodiments of the present invention, and together with the description serve to explain the principles of the inventive concept.

FIG. 9 is a table illustrating the number of frames operating in the first blue drive mode, the mixed drive mode, and the second blue drive mode for a first exemplary color coordinate, a second exemplary color coordinate, and a third exemplary color coordinate of FIG. 7.

DETAILED DESCRIPTION OF THE ILLUSTRATED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. The same reference numbers indicate the same components throughout the specification. In the attached figures, the thickness of layers and regions is exaggerated for clarity.

It will be understood that when an element or layer is referred to as being "connected to," or "coupled to" another element or layer, it can be directly connected to or coupled to another element or layer or intervening elements or layers may be present. In contrast, when an element is referred to as being "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings of the present invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Unless defined otherwise, all technical and scientific terms used herein have the same meaning as commonly understood by one of ordinary skill in the art to which this invention belongs. It is noted that the use of any and all examples, or exemplary terms provided herein is intended merely to better illuminate the invention and is not a limitation on the scope of the invention unless otherwise specified. Further, unless defined otherwise, all terms defined in generally used dictionaries may not be overly interpreted.

Figure 1:
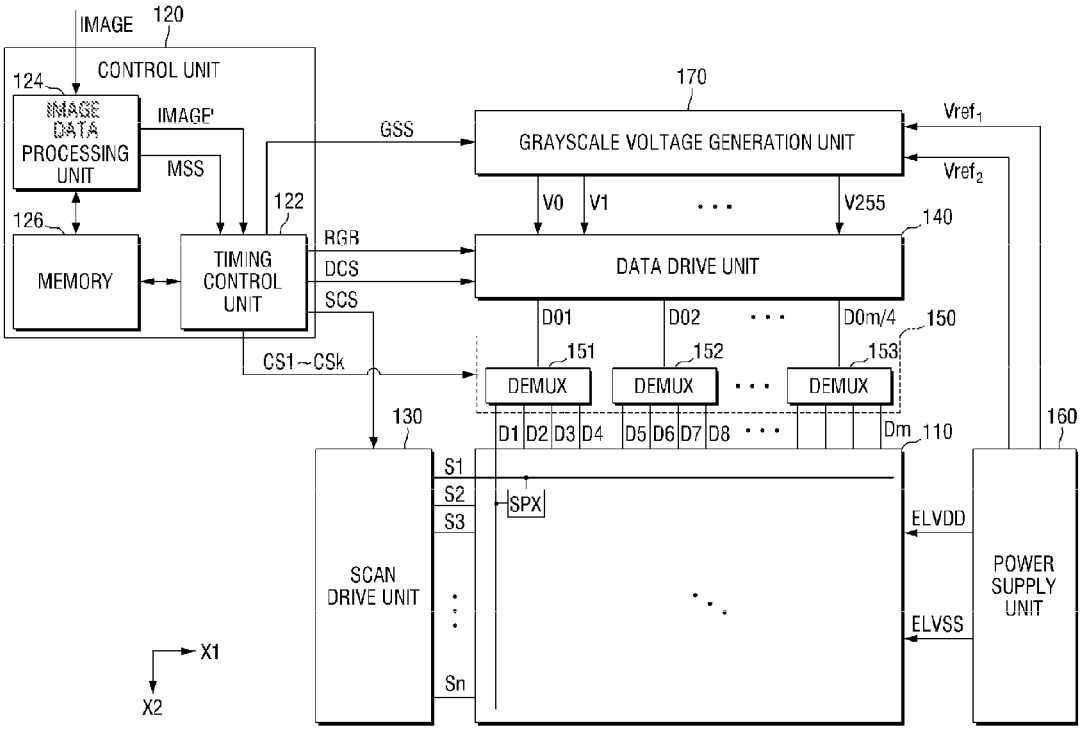
FIG. 1 is a block diagram schematically illustrating a configuration of an organic light emitting display device according to an exemplary embodiment of the present invention.

FIG. 1 is a block diagram schematically illustrating a configuration of an organic light emitting display device according to an exemplary embodiment of the present invention.

Referring to FIG. 1, the organic light emitting display device includes a display panel 110, a control unit 120, a scan drive unit 130, a data drive unit 140, a de-multiplexer circuit (DEMUX) 150, a power supply unit 160, and a grayscale voltage generation unit 170.

The display panel 110 includes scan lines (S1 to Sn) extending in a first direction X1, data lines (D1 to Dm) extending in a second direction X2, and sub-pixels SPX connected to the scan lines (S1 to Sn) and the data lines (D1 to Dm), respectively. The sub-pixels SPX may include red sub-pixels R, green sub-pixels G, first blue sub-pixels B1, and second blue sub-pixels B2. The configuration and operation of each sub-pixels SPX will be described in detail below with reference to FIGS. 2 to 4.

The control unit 120 may process raw image data IMAGE provided from outside to an image signal RGB, and provide the image signal RGB to the data drive unit 140. In particular, according to an exemplary embodiment of the present invention, the control unit 120 may provide a first blue drive selection signal or a mixed drive selection signal to the de-multiplexer circuit 150 in the unit of frame of the raw image data IMAGE, detect image data that corresponds to a first color gamut A1 and a second color gamut A2 from the raw image data IMAGE, and adjust a ratio of a number of frames operating in the first blue drive mode that provides a first blue drive selection signal to the de-multiplexer circuit 150 and a number of frames operating in the mixed drive mode that provides a mixed drive mode selection signal, based on the image data corresponding to the second color gamut A2.

In order to perform the functions as described above, the control unit 120 according to an exemplary embodiment of the present invention may include an image data processing unit 124, a timing control unit 122, and a memory 126.

The timing control unit 122 may receive a corrected image data IMAGE' from the image data processing unit 124, process the corrected image data IMAGE' to the image signal RGB, and transmit the image signal RGB to the data drive unit 140. The timing control unit 122 may output data control signal DCS and scan control signal SCS for driving the data drive unit 140 and the scan drive unit 130 in synchronization with the image signal RGB. The corrected image data IMAGE' may be processed into the image signal RGB to correspond to grayscale values or grayscale voltages of each sub-pixel of the display panel 110. The timing control unit 122 may also modulate or compensate the corrected image data IMAGE', depending on the user's preference and the characteristics of the organic light emitting display device, to process the corrected image data IMAGE' into the image signal RGB.

The timing control unit 122 may provide sub-pixel selection signal to the de-multiplexer circuit 150. The de-multiplexer circuit 150 may select the sub-pixel to which data output signals (D01 to D0*m*/4) are applied, to adjust the drive mode between the first blue drive mode, the second blue drive mode, or the mixed drive mode.

The image data processing unit 124 may receive the raw image data IMAGE to generate the corrected image data IMAGE'. Specifically, the image data processing unit 124 may detect the image data that corresponds to the first color gamut A1 and the second color gamut A2 from the raw image data IMAGE, and adjust the ratio between the number of frames operating in the first blue drive mode and the number of frames operating in the mixed drive mode in the de-multiplexer circuit 150, based on the second color gamut A2 from the raw image data IMAGE.

The image data processing unit 124 may correct the grayscale level of the image data of the frame that operates in the mixed drive mode from the raw image data IMAGE, to match the grayscale versus voltage curve (hereinafter, referred to as "first blue drive mode gamma curve") corresponding to the first blue drive mode.

Furthermore, the image data processing unit 124 may determine positions of the first color gamut A1 and the second color gamut A2, determine the drive mode frame ratio that corresponds to the ratio of the number of frames operating in the first blue drive mode to the number of frames operating in the mixed drive mode, and store the positions and the drive mode frame ratio in the memory 126 or read the positions and the drive mode frame ratio stored in the memory 126. The image data processing unit 124 may store the received image data or the corrected image data IMAGE' in the memory 126.

The image data processing unit 124 may transmit a mode selection signal MSS, which indicates whether the current frame operates in the first blue drive mode, in the mixed drive mode, or in the second blue drive mode, to the timing control unit 122. The timing control unit 122 may transmit drive selection signals (CS1 to CSk) corresponding to the received mode selection signal MSS to the de-multiplexer circuit 150.

A method of implementation and operation of the image data processing unit 124 according to an exemplary embodiment of the present invention will be described in detail below with reference to FIGS. 6 to 9.

The memory 126 may be a non-volatile memory that may store display device specific information, such as a look-up table related to the standard, characteristics, and the gamma curve of the display device, while the power of the display device is turned off. The memory 126 may include a flash memory, an electrically erasable programmable read-only memory (EEPROM), or the like. Furthermore, the memory 126 may include a volatile memory, such as DRAM, SRAM, and the like, which may store information related to the current frame image data, the positions of the first color gamut A1 and the second color gamut A2, and the ratio of the number of frames operating in the first blue drive mode to the number of frames operating in the mixed drive mode, while the power of the display device is turned on.

In FIG. 1, the timing control unit 122 and the image data processing unit 124 are illustrated as separate functional blocks. According to an exemplary embodiment of the present invention, the image data processing unit 124 may be a part of the image processing algorithm of the timing control unit 122, or an algorithm that performs the image correction function. The timing control unit 122 and the image data processing unit 124 may be a single module that is built into a single IC chip.

The scan drive unit 130 may receive the scan control signal SCS from the timing control unit 122 and sequentially drive the scan lines (S1 to Sn) in response to receiving the scan control signal SCS.

The data drive unit 140 receives the image signal RGB and the data control signal DCS from the timing control unit 122, and outputs the data output signals (D01 to D0*m*/4) for driving the data lines (D1 to Dm) in response receiving the image signal RGB and the data control signal DCS. For example, the data output signal D01 may be provided to the data lines (D1, D2, D3, D4) through the de-multiplexer circuit 150, the data output signal DO2 may be provided to the data line (D5, D6, D7, D8) through the de-multiplexer circuit 150, and the data output signal D0*m*/4 may be provided to the data lines (Dm-3, Dm-2, Dm-1, Dm) through the de-multiplexer circuit 150.

More specifically, the data drive unit 140 may receive grayscale voltages (V0 to V255) from the grayscale voltage generation unit 170, select one or more of the received grayscale voltages (V0 to V255) and transmit the selected grayscale voltage to the de-multiplexer circuit 150 as the data output signals (D01 to D0*m*/4). According to an exemplary embodiment of the present invention, the data output signal (D01 to D0*m*/4) may be sequentially selected signals to provide time order for grayscale voltages (V0 to V255) applied to the red sub-pixels R, the green sub pixels G, and the first blue sub-pixel B1, or the red sub-pixels R, the green sub-pixels G, the first blue sub-pixels B1, and the second blue sub-pixels B2.

The de-multiplexer circuit 150 may include de-multiplexers (151 to 153). Each of the de-multiplexers (151 to 153) may receive the data output signals (D01 to D0*m*/4), distribute the received data output signals (D01 to D0*m*/4) in terms of the corresponding time, and selectively transmit the signals to the four data lines. For example, the de-multiplexer 151 may divide the data output signal D01 into three in terms of time, transmit a first temporal signal to the first data line D1, a second temporal signal to the second data line D2, and a third temporal signal to the third data line D3, the fourth data line D4, or both the third and fourth data lines (D3, D4). Similarly, the de-multiplexer 152 may temporally distribute the data output signal D02, and selectively transmit the temporally divided signals to the four data lines (D5, D6, D7, and D8). The de-multiplexer circuit 150 and the data drive unit 140 are illustrated as separate functional blocks in FIG. 1, however, according to an exemplary embodiment of the present invention, the de-multiplexer circuit 150 and the data drive unit 140 may be integrally formed in the same IC chip and connected to at least a part of the display panel 110. Alternatively, the de-multiplexer circuit 150 and the data drive unit 140 may be integrated as a single drive unit IC together with the control unit 120 or the scan drive unit 130, and formed on at least a partial area of the display panel 110.

The power supply unit 160 may be a voltage source that provides corresponding voltage to each constituent element of the display panel 110. In particular, according to an exemplary embodiment of the present invention, the power supply unit 160 may provide power supply voltages ELVDD and ground voltage ELVSS to the sub-pixels of the display panel 110, a first reference voltage Vref1 and a second reference voltage Vref2 to the grayscale voltage generation unit 170.

The grayscale voltage generation unit 170 may receive at least the first reference voltage Vref1 and the second reference voltage Vref2 from the power supply unit 160, and distribute the first reference voltage Vref1 and the second reference voltage Vref2 to generate the grayscale voltages (V0 to V255).

In FIG. 1, although the grayscale voltage generation unit 170 is illustrated to produce 256 grayscale voltages (V0 to V255), types of grayscale voltages generated by the grayscale voltage generation unit 170 may increase or decrease depending on the display quality, size of the display panel 110, and the driving method of the display panel 110 and the data drive unit 140.

The grayscale voltage generation unit 170 may receive the grayscale voltage selection signal provided from the timing control unit 122, and adjust the voltage level of the grayscale voltages (V0 to V255) to output, according to the received grayscale voltage selection signal.

Figure 2:
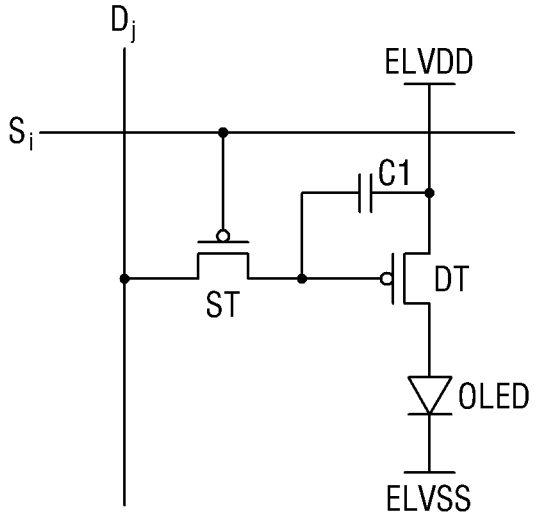
FIG. 2 is a diagram illustrating sub-pixels illustrated in FIG. 1.

FIG. 2 is a diagram illustrating a sub-pixel illustrated in FIG. 1.

Referring to FIG. 2, the sub-pixel SPXij is connected an i-th scan line Si and a j-th data line Dj (i and j are positive integers, respectively). The sub-pixel SPXij includes a switching transistor ST, a drive transistor DT, a capacitor C1, and an organic light emitting device OLED. The switching transistor ST transmits the data output signals (D01 to D0*m*/4) supplied via the data line Dj to the drive transistor DT in response to a scan signal supplied to the scan line Si.

The drive transistor DT may control a current flowing from the drive power supply voltage ELVDD to the organic light emitting device OLED in response to the data output signals (D01 to D0*m*/4) that are transmitted through the switching transistor ST. The capacitor C1 is connected between the gate electrode and the ground voltage ELVDD of the drive transistor DT. The capacitor C1 stores the voltage corresponding to the data output signals (D01 to D0*m*/4) transmitted to the gate electrode of the drive transistor DT, and maintains the turn-on state of the drive transistor DT in the stored voltage during at least one frame.

The organic light emitting device OLED is electrically connected between the source electrode and the ground voltage ELVSS of the drive transistor DT, and emits light corresponding to the data output signals (D01 to D0*m*/4) supplied from the drive transistor DT.

According to an exemplary embodiment of the present invention, the sub-pixel SPXij may also include at least one compensation transistor (not illustrated) and at least one compensation capacitor (not illustrated) for compensating a threshold voltage of the drive transistor DT. The sub-pixel SPXij may further include an emitting transistor (not illustrated) for selectively supplying the current supplied to the organic light emitting device OLED from the drive transistor DT.

The sub-pixel SPXij may control the magnitude of the current flowing from the power supply voltage ELVDD to the organic light emitting device OLED using the switching of the drive transistor DT according to the data output signals (D01 to D0*m*/4), to allow the light emitting layer of the organic light emitting device OLED to emit light, thereby expressing a predetermined color.

The sub-pixel SPXij may be divided into a red sub-pixel R including an organic light emitting material of red color, a green sub-pixel G including a green organic light emitting material, a first blue sub-pixel B1 including a sky blue organic light emitting material, and a second blue sub-pixel B2 including a deep blue organic light emitting material, depending on the organic light emitting material forming the light emitting layer to express the predetermined color.

The first and second blue sub-pixels (B1, B2) have different brightness characteristics from each other. More particularly, when the same voltage is applied to an anode of the organic light emitting device OLED, brightness of the first blue sub-pixel B1 that includes the sky blue organic light emitting material may generally be higher than the second blue sub-pixel B2 that includes the deep blue organic light emitting material.

Figure 3:
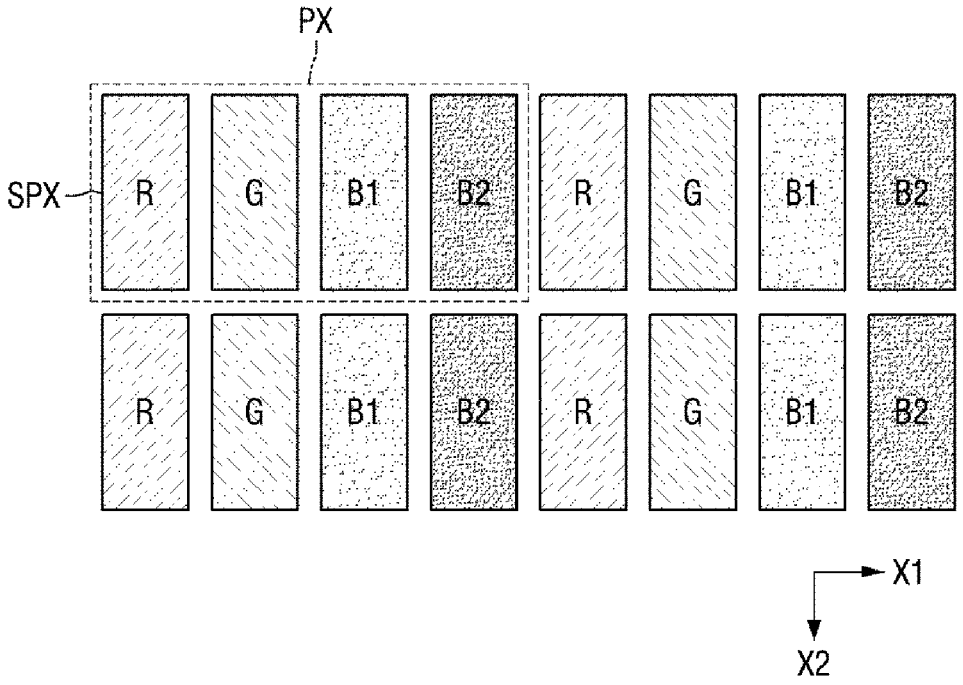
FIG. 3 is a diagram illustrating a pixel arrangement according to an exemplary embodiment of the present invention disposed on the display panel illustrated in FIG. 1.

FIG. 3 is a diagram illustrating the pixel arrangement disposed on the display panel illustrated in FIG. 1, according to an exemplary embodiment of the present invention.

Referring to FIG. 3, the pixel PX includes four sub-pixels SPX. Each of the four sub-pixels SPX may be a red sub-pixel R, a green sub-pixel G, a first blue sub-pixel B1, and a second blue sub-pixel B2. The red sub-pixel R, the green sub-pixel G, the first blue sub-pixel B1, and the second blue sub-pixel B2 may repeatedly be disposed side by side in the first direction X1 and in the second direction X2.

The red sub-pixel R, the green sub-pixel G, the first blue sub-pixel B1, and the second blue sub-pixel B2 within one pixel PX are connected to the same scan line and four data lines, respectively.

As used herein, "pixel" may correspond to one "point" in the image data, in which a plurality of "point" gathers to form one image, and "sub-pixel" may correspond to one point of the plurality of points on the display panel 110 for expressing one "pixel or point", for example, R pixel, G pixel, and B pixel.

Figure 4:
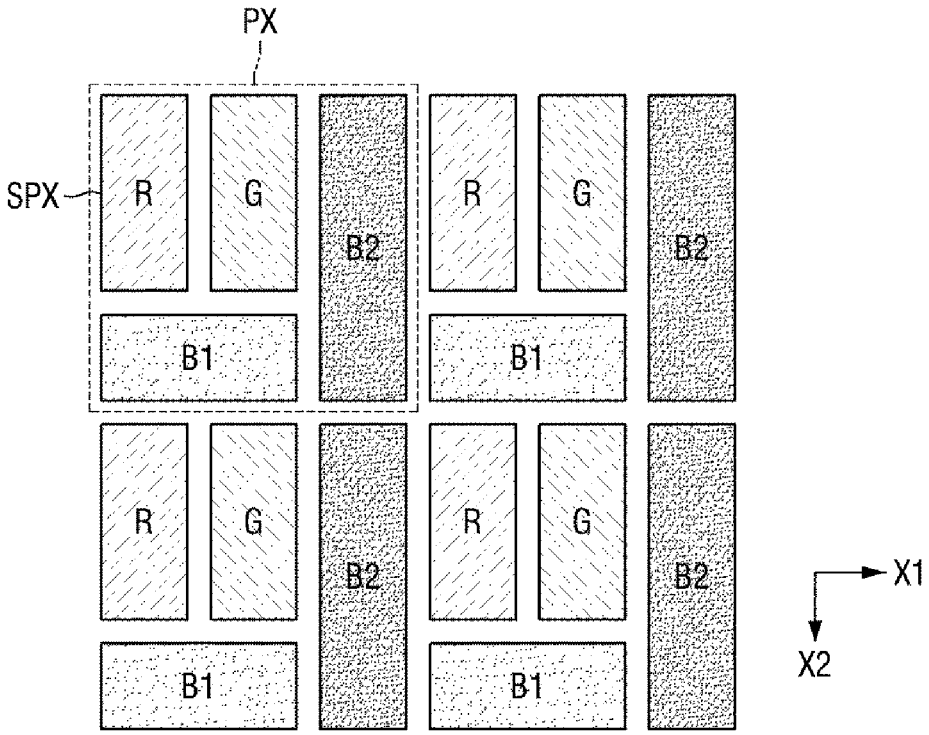
FIG. 4 is a diagram illustrating a pixel arrangement according to an exemplary embodiment of the present invention disposed on the display panel illustrated in FIG. 1.

FIG. 4 is a diagram illustrating a pixel arrangement disposed on the display panel illustrated in FIG. 1, according to an exemplary embodiment of the present invention.

Referring to FIG. 4, the pixel PX includes four sub-pixels SPX. Each of the four sub-pixels SPX may be the red sub-pixel R, the green sub-pixel G, the first blue sub-pixel B1, and the second blue sub-pixel B2. The red sub-pixel R, the green sub-pixel G, and the second blue sub-pixel B2 may be repeatedly arranged side by side in the first direction X1. The red sub-pixel R and the first blue sub-pixel B1 may be sequentially arranged in the second direction X2, and the length of the first blue sub-pixel B1 in the first direction X1 may substantially be similar to the sum of the lengths of the red sub-pixel R and the green sub-pixel G in the first direction X1. The length of the second blue sub-pixel B2 in the second direction X2 may substantially be similar to the sum of the lengths of the red sub-pixel G and the first blue sub-pixel B1 in the second direction X2.

The red sub-pixel R, the green sub-pixel G, the first blue sub-pixel B1, and the second blue sub-pixel B2 within one pixel PX are connected to the same scan line and to the four data line, respectively.

Figure 5:
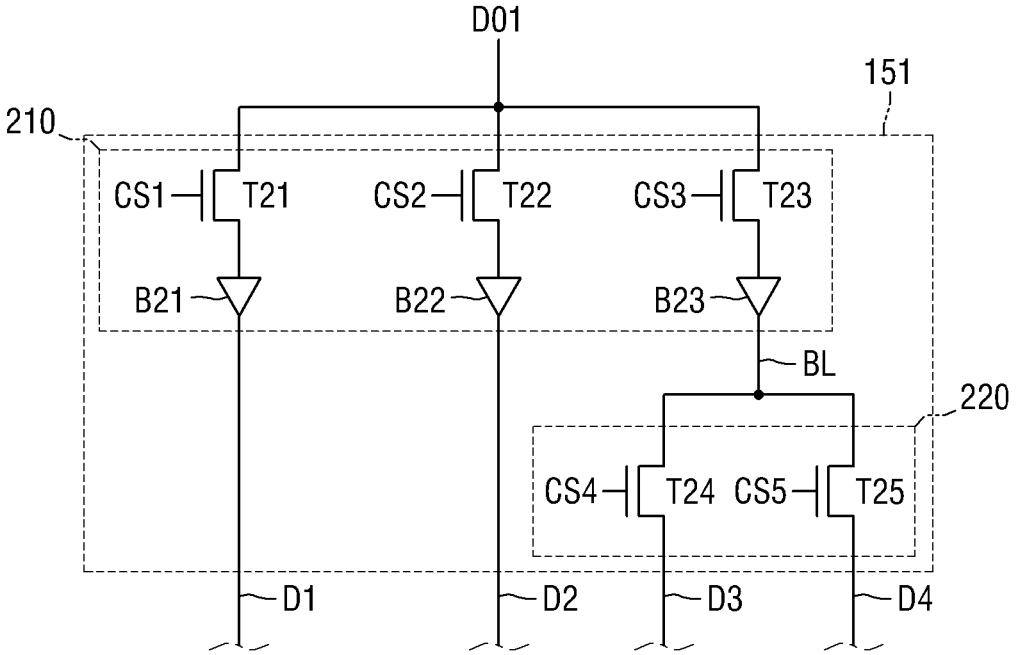
FIG. 5 is a circuit diagram illustrating a configuration of a de-multiplexer illustrated in FIG. 1.

FIG. 5 is a circuit diagram illustrating a configuration of the de-multiplexer illustrated in FIG. 1. Since the de-multiplexers (152 to 153) illustrated in FIG. 1 are substantially similarly to the de-multiplexer 151 illustrated in FIG. 5, repeated description of the substantially similar elements and operations of the de-multiplexers (152 to 153) will be omitted.

Referring to FIG. 5, the de-multiplexer 151 includes a first selection circuit 210 and a second selection circuit 220. The first selection circuit 210 outputs the data output signal D01 to any one of a first data line D1, a second data line D2, and a blue line BL in response to the drive selection signals (CS1 to CS3) from the timing control unit 122 illustrated in FIG. 1. The selection signals (CS1 to CS3) may include a red selection signal CS1, a green selection signal CS2, and a blue selection signal CS3.

The first selection circuit 210 may include first to third transistors (T21 to T23) and first to third buffers (B21 to B23). The first transistor T21 may be connected between the data output signal D01 and the input terminal of the first buffer B21 and include a gate electrode connected to the red selection signal CS1. The second transistor T22 may be connected between the data output signal D01 and the input terminal of the second buffer B22 and include a gate electrode connected to the green selection signal CS2. The third transistor T23 may be connected between the data output signal D01 and the input terminal of the third buffer B23 and include a gate electrode connected to the blue selection signal CS3.

The first buffer B21 is connected between the first transistor T21 and the first data line D1. The second buffer B22 is connected between the second transistor and T22 and the second data line D2. The third buffer B23 is connected between the third transistor and T23 and the blue Line BL.

The second selection circuit 220 may output the data output signal D01 of the blue line BL to any one of the third data line D3 and the fourth data line D4 in response to the selection signals (CS4, CS5) from the timing control unit 122 illustrated in FIG. 1. Each of the selection signals (CS4, CS5) may include a first blue selection signal CS4 and a second blue selection signal CS5.

The second selection circuit 220 may include a fourth transistor T24 and a fifth transistor T25. The fourth transistor T24 is connected between the blue line BL and the third data line D3, and includes a gate electrode connected to the first blue selection signal CS4. The fifth transistor T25 is connected between the blue line BL and the fourth data line D4, and includes a gate electrode connected to the second blue selection signal CS5.

Each of the first blue selection signal CS4 and the second blue selection signal CS5 may adjust light emission from the first blue sub-pixel B1 connected to the third data line D3 or the second blue sub-pixel B2 connected to the fourth data line D4. The drive mode of the organic light emitting display device according to an exemplary embodiment of the present invention may vary depending on which of the first blue sub-pixel B1 and the second blue sub-pixel B2 emits light.

Hereinafter, a drive mode in which the first blue sub-pixel B1 emits light and the second blue sub-pixel B2 does not emit light is defined as a "first blue drive mode." During the first blue drive mode, the first blue selection signal CS4 in an on-state and the second blue selection signal CS5 in an off-state may be referred to as a "first blue drive selection signal." Furthermore, a drive mode in which both the first blue sub-pixel B1 and the second blue sub-pixel B2 emit light is defined as a "mixed drive mode." During the mixed drive mode, both the first blue selection signal CS4 and the second blue selection signal CS5 in the on-state may be referred to as a "mixed drive selection signal." Furthermore, a drive mode, in which the first blue sub-pixel B1 does not emit light and the second blue sub-pixel B2 emits light, is defined as a "second blue drive mode." During the second blue drive mode, the first blue selection signal CS4 in the off-state and the second blue selection signal CS5 in the on-state may be referred to as a "second blue drive selection signal."

The configuration and operation of the image data processing unit 124 according to an exemplary embodiment of the present invention will now be described in detail with reference to FIGS. 6 to 9.

Figure 6:
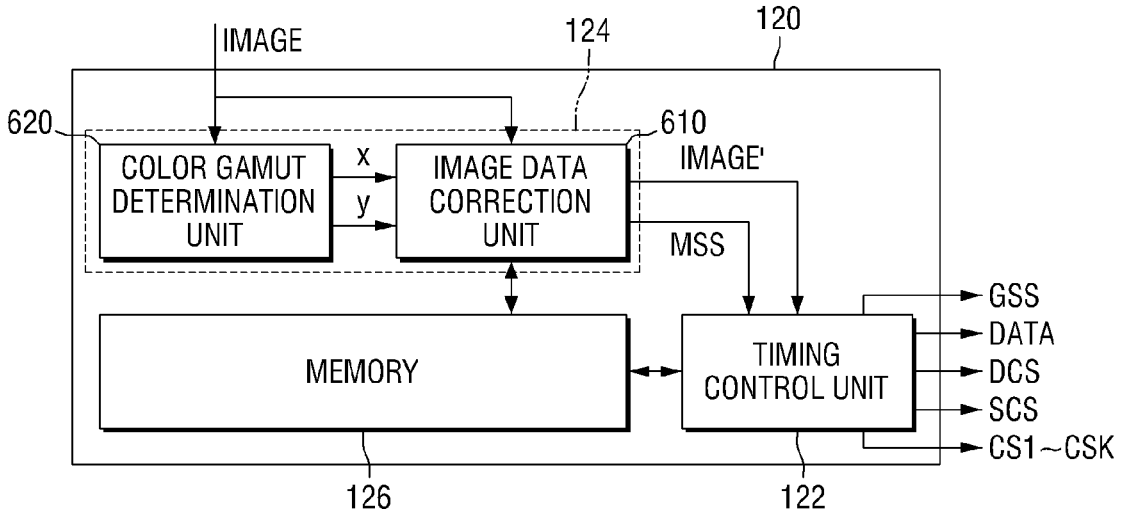
FIG. 6 is a block diagram schematically illustrating a control unit according to an exemplary embodiment of the present invention.

FIG. 6 is a block diagram schematically illustrating a control unit according to an exemplary embodiment of the present invention.

Figure 7:
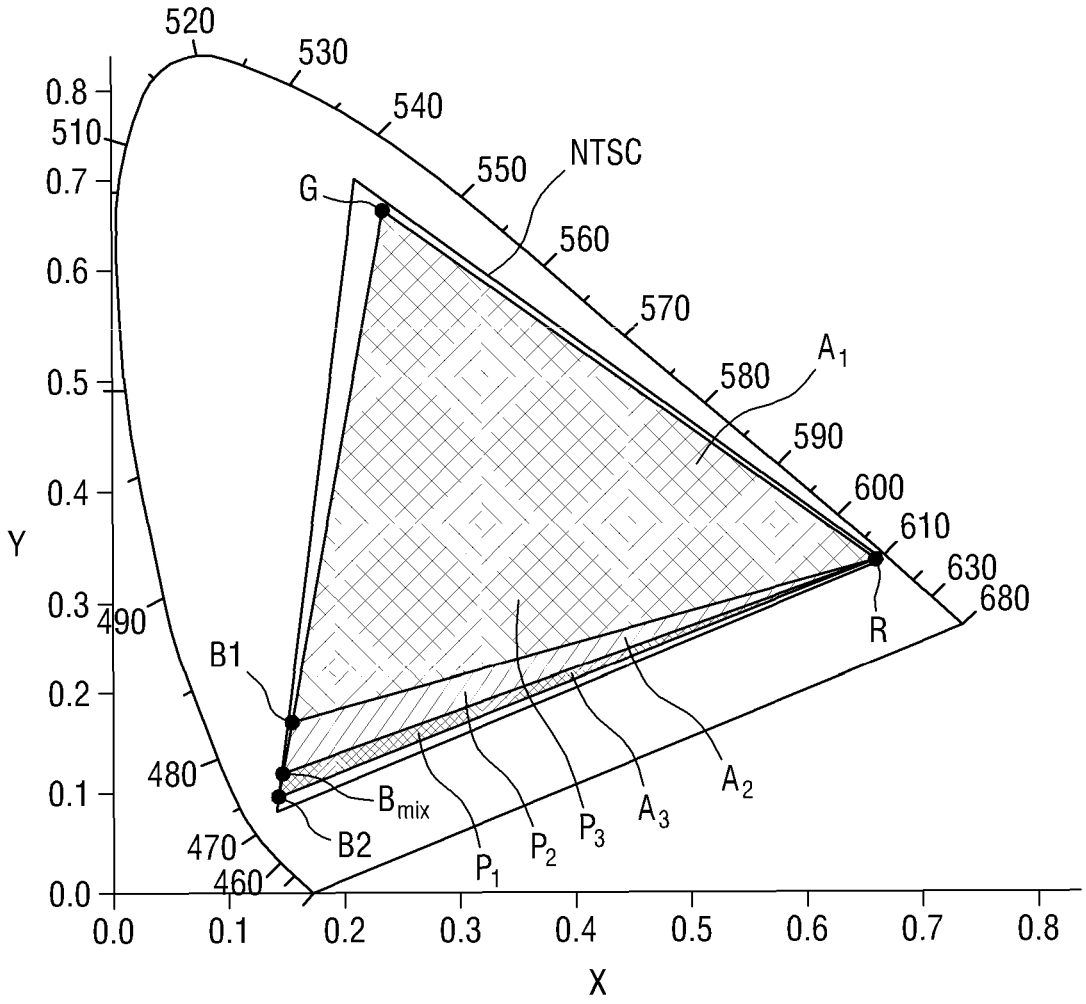
FIG. 7 is a color coordinate diagram illustrating a color gamut in which a first blue drive mode, a second blue drive mode, and a mixed drive mode may be expressed on the color coordinate CIE.

FIG. 7 is a color coordinate diagram illustrating a color gamut in which the first blue drive mode, the second blue drive mode, and the mixed drive mode may express on the color coordinate CIE, according to the National Television Standards Committee NTSC standards.

Figure 8:
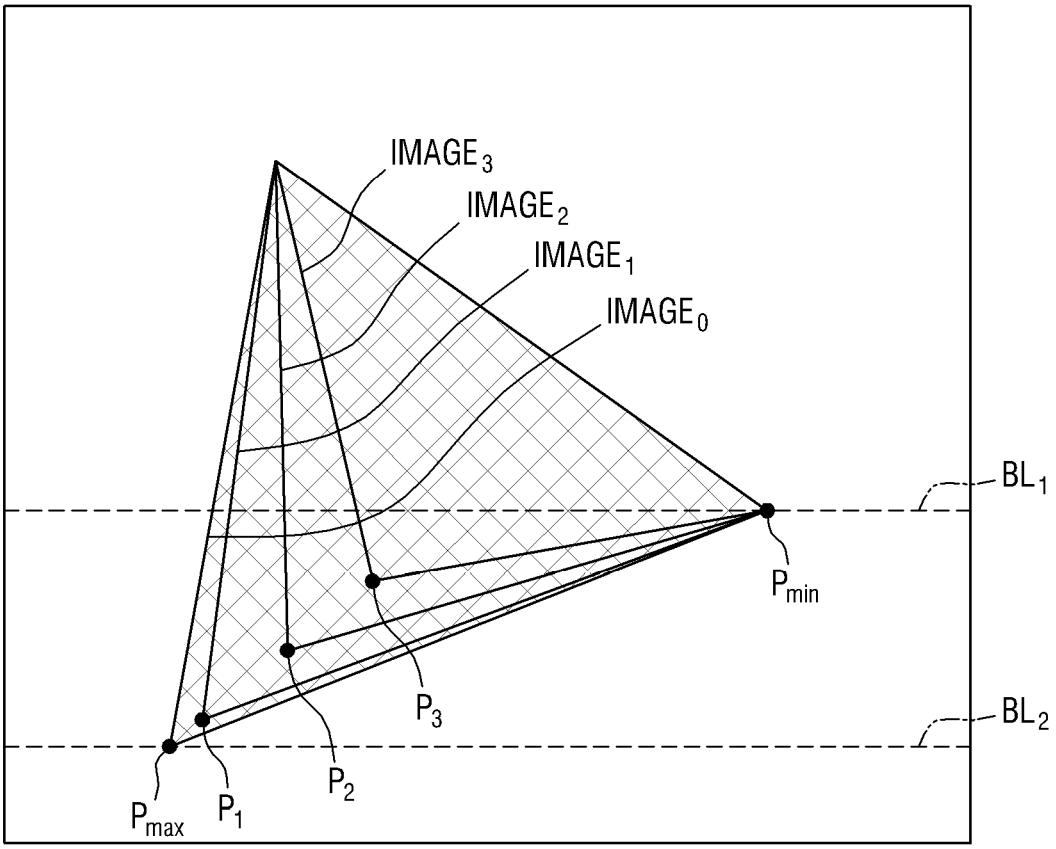
FIG. 8 is a view illustrating that various images obtained by modifying the color gamut illustrated in FIG. 7 are displayed on the display panel.

FIG. 8 is a view illustrating images with modified color gamut illustrated in FIG. 7 displayed on the display panel.

Referring to FIG. 6, the image data processing unit 124 according to an exemplary embodiment of the present invention may include an image data correction unit 610 and a color gamut determination unit 620.

The color gamut determination unit 620 may receive the raw image data IMAGE and determine location of a color gamut on the color coordinate CIE for each of the pixels or points of the raw image data IMAGE.

Referring to FIG. 7, the first blue sub-pixel B1 emits light of relatively lighter blue color as compared to the second blue sub-pixel B2, and a combination of the first blue sub-pixel B1, the red sub-pixel R, and the green sub-pixels G may display the colors in the first color gamut A1.

When both the first blue sub-pixel B1 and the second blue sub-pixel B2 emit light, the combination of the first blue sub-pixel B1, the second blue sub-pixel B2, the red sub-pixel R, and the green sub-pixels G may display light of the first color gamut A1 and the second color gamut A2. In other words, the second color gamut A2 may be defined as a gamut that may be expressed when all the first blue sub-pixel B1, the second blue sub-pixel B2, the red sub-pixel R, and the green sub-pixel G emit light, excluding the first color gamut A1.

The second blue sub-pixel B2 may emit light of the darker blue color as compared to the first blue sub-pixel B1, and a combination of the second blue sub-pixel B2, the red sub-pixel R, and the green sub-pixel G may display light of the first color gamut A1, the second color gamut A2, and the third color gamut A3. In other words, the third color gamut A3 may be defined as a gamut that may be expressed when all the second blue sub-pixel B2, the red sub-pixel R, and the green sub-pixel G emit light, excluding the second gamut A2.

Referring back to FIG. 6, the color gamut determination unit 620 may provide position values (x, y) of the pixels corresponding to the second color gamut A2 or the third color gamut A3 to the image data correction unit 610, from the color coordinate values of each pixel of the raw image data IMAGE.

The color gamut determination unit 620 may also detect the image data corresponding to the first color gamut A1 and the second color gamut A2 from the raw image data IMAGE, and determine the ratio of drive mode frame ratio, which corresponds to the ratio of the number of frames operating in the first blue drive mode and the number of frames operating in the mixed drive mode, based on the image data corresponding to the second color gamut A2.

The color gamut determination unit 620 may detect the image data corresponding to the third color gamut A3 from the raw image data IMAGE, and determine the ratio of the drive mode frame ratio, which corresponds to the ratio of the number of frames operating in the first blue drive mode, the number of frames operating in the mixed drive mode, and the number of frames operating in the second blue drive mode, based on the image data corresponding to the second color gamut A2 and the third color gamut A3.

Referring to FIG. 8, a color coordinate from the sole emission of the second blue sub-pixel B2 in the color coordinate CIE is assumed to be a maximum blue color coordinate Pmax, and an image displaying the internal color gamuts of the color coordinates CIE of the maximum blue color coordinate Pmax, the red sub-pixel R, and the green sub-pixel G is illustrated as a 0-th exemplary image IMAGE0. Each image displaying the internal color gamuts of the color coordinates of the red sub-pixel R, the green sub-pixel G, and a first exemplary color coordinate P1, a second exemplary color coordinate P2, and a third exemplary color coordinate P3 as, an alternative color coordinates to the maximum blue color coordinate Pmax, are illustrated as a first exemplary image IMAGE1, a second exemplary image IMAGE2, and a third exemplary image IMAGE3, respectively.

When the 0-th exemplary image IMAGE0 is displayed on the display panel, a pixel having the color coordinate value of the maximum blue color coordinate Pmax may be reproduced only by the second blue sub-pixel that emits the deep blue light.

Therefore, the organic light emitting display device according to an exemplary embodiment of the present invention may operate the 0-th exemplary image in the second blue drive mode throughout the entire frames. Alternatively, the organic light emitting display device may be operated in the mixed drive mode with a possibility of reduced color reproducibility.

When the first exemplary image IMAGE1 is displayed on the display panel, since the first exemplary color coordinate P1 is located in the third color gamut A3, the organic light emitting display device may not fully reproduce the color corresponding to the first exemplary color coordinate P1 in the first blue drive mode in which the first blue sub-pixel B1 emits the sky blue light or in the mixed drive mode in which the first blue sub-pixel B1 and the second blue sub-pixel B2 emit light.

However, the first exemplary image IMAGE1 and the first exemplary color coordinate P1 may be reproduced in the second blue drive mode in which only the second blue sub-pixel B2 emits deep blue light.

The second exemplary image IMAGE2 including the second exemplary color coordinate P2 corresponding to the second color gamut A2 may be reproduce color in the mixed drive mode or the second blue drive mode, but may not be reproduced in the first blue drive mode.

The third example image IMAGE3 including the third exemplary color coordinate P3 corresponding to the first color gamut A1 may reproduce the color in the first drive mode, in addition to the mixed drive mode and the second blue drive mode.

In order to reproduce the color of an image having any color coordinate value, the organic light emitting display device according to an exemplary embodiment of the present invention may prioritize each of the first blue drive mode, the mixed drive mode, and the second blue drive mode. Specifically, if all the first blue drive mode, the mixed drive mode, and the second blue drive mode may reproduce the color of a particular pixel, the organic light emitting display device may prioritize the driving mode in the order of the first blue drive mode, the mixed drive mode, and the second blue drive.

For example, although the color of pixel having the color of the third exemplary color coordinate P3 may be reproduced in one of the first blue drive mode, the mixed drive mode, and the second blue drive mode, since the first blue drive mode is prioritized, the pixel having the color of the third exemplary coordinate P3 may reproduce the color in the first blue drive mode.

Further, in prioritizing the first blue drive mode, the mixed drive mode, and the second blue drive mode, the organic light emitting display device according to an exemplary embodiment of the present invention may adjust the ratio of the number of frames operating in the first blue drive mode, the number of frames operating in the mixed drive mode, and the number of frames operating in the second blue drive mode.

Specifically, if the number of frames operating in the first blue drive mode and the number of frames operating in the mixed drive mode are the same, the color reproduced in the first blue drive mode and the color reproduced in the mixed drive mode may be dithered one-to-one, and a color gamut recognized by a viewer may be an intermediate value of the color gamut A1 that may be expressed in the first blue drive mode and a color gamut (sum of A1 and A2) that may be expressed in the mixed drive mode. For example, although the color of pixel having the second exemplary color coordinate P2 may not be reproduced only in the first blue drive mode, as long as the color of the pixel may be reproduced by adjusting the number of frames operating in the first blue drive mode and the number of frames operating in the mixed drive mode, the number of frames of the first blue drive mode may be maximized by prioritizing the first blue drive mode when determining the ratio of the number of frames operating in the first blue drive mode and the number of frames operating in the mixed drive mode.

FIG. 9 is a table illustrating number of frames operating in the first blue drive mode, the mixed drive mode, and the second blue drive mode in the first exemplary color coordinate P1, the second exemplary color coordinate P2, and the third exemplary color coordinate P3 of FIG. 7.

Referring to FIG. 9, although the color of pixel having the color of the first exemplary color coordinate P1 may not be reproduced only in the mixed drive mode, as long as the color of the pixel may be reproduced by adjusting the ratio of the number of frames operating in the mixed drive mode and the number of frames operating in the second blue drive mode, the number of frames of the mixed drive mode may be maximized in the ratio by prioritizing the mixed drive mode.

FIG. 9 illustrates that the number of frames operating in the mixed drive mode and the number of frames operating in the second blue drive mode may have a one to one ratio in the pixel having the color of the first exemplary color coordinate P1.

Although FIG. 9 illustrates that the mixed drive mode or the second blue drive mode may be operated in the unit of frame in the first exemplary color coordinate P1 corresponding to the first color gamut A1, according to an exemplary embodiment of the present invention, the second blue drive mode may not be used, and in the image data having the color corresponding to the first color gamut A1, the frame may only be operated in the mixed drive mode while reducing color reproducibility.

Referring back to FIG. 9, although the color of pixel having the color of the second exemplary color coordinate P2 may not be reproduced only in the first blue drive, as long as the color of the pixel may be reproduced by adjusting the ratio of the number of frames operating in the first blue drive mode to the number of frames operating in the mixed drive mode, the number of frames of the first blue drive mode may be maximized in the ratio by prioritizing the first blue drive mode.

FIG. 9 illustrates that the number of frames operating in the first blue drive mode and the number of frames operating in the mixed drive mode are at a ratio of three to one in the pixel having the color of the second exemplary color coordinate P2.

In FIG. 9, since the color of pixel having the color of the first exemplary color coordinate P1 may be reproduced in the first blue drive mode, the mixed drive mode, and the second blue drive mode, the color of the pixel may be reproduced by operating only in the first blue drive mode that has the priority.

Thus, by prioritizing the operation in the order of the first blue drive mode, the mixed drive mode, and the second blue drive mode, the organic light emitting display device according to an exemplary embodiment of the present invention may extend emission frequency and emission time of the first blue sub-pixel, which has relatively high luminous efficiency and emits sky blue light that may increase use life of the organic light emitting display device, as long as the desired color is reproduced. More particularly, the organic light emitting display device may reduce the emission frequency and the emission time of the second blue sub-pixel that may decrease the useful life of the organic light emitting display device. Accordingly, the useful life and energy efficiency of the organic light emitting display device may be improved according to the present exemplary embodiment.

Referring back to FIG. 6, the image data correction unit 610 may receive the position values (x, y) of the pixel corresponding to the second color gamut A2 or the third color gamut A3 in the raw image data IMAGE from the color gamut determination unit 620, or receive the drive mode frame ratio corresponding to the ratio of the number of frames operating in the first blue drive mode to the number of frames operating in the mixed drive mode to the number frames operating in the second blue drive mode. The image data correction unit 610 may correct the image data of the mixed drive mode or the image data of the second blue drive mode, to match the mixed drive mode or the second blue drive mode. The operation of the image data correction unit 610 correcting the image data to match the mixed drive mode or the second blue drive mode will be described in detail with reference to FIG. 13.

The timing control unit 122 receives the corrected image data IMAGE' from the image data correction unit 610, and provides the de-multiplexer circuit 150 with the mixed drive selection signal. More particularly, the first blue selection signal CS4 and the second blue selection signal CS5 of the on-state are provided to the de-multiplexer circuit 150, when the corrected image data IMAGE' (i.e., the data output signals (D01 to D0*m*/4) equivalent to the image data that corresponds to the frame operating in the second blue drive mode or the mixed drive mode) is provided from the data drive unit 140 to the de-multiplexer circuit 150.

Next, the driving method of the organic light emitting display device according to an exemplary embodiment of the present invention that operates in the drive frame ratio as illustrated in FIG. 9 will be described.

Figure 10:
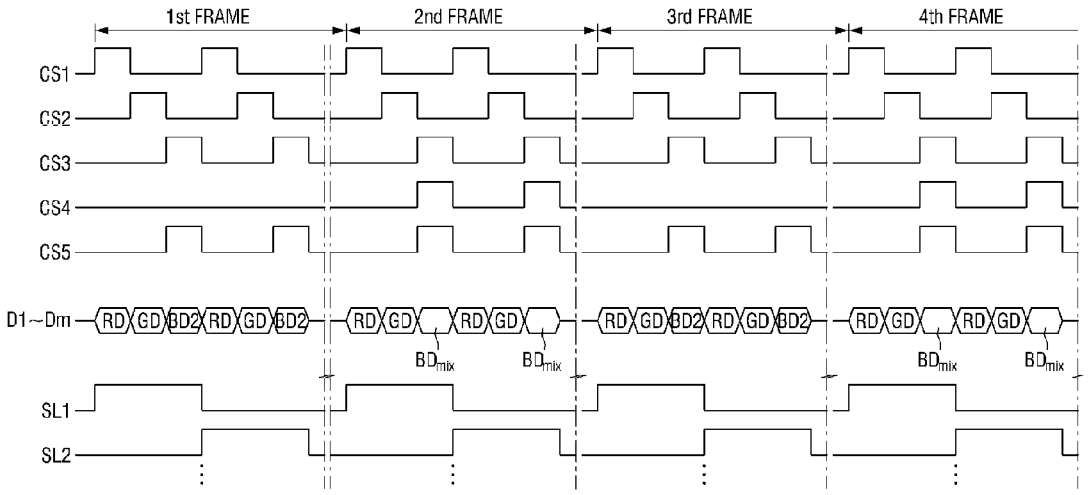
FIG. 10 is a timing diagram illustrating the time at which the organic light emitting display device according to an exemplary embodiment of the present invention is operated with a drive mode frame ratio as illustrated in FIG. 9, to express the pixels having the first exemplary color coordinate illustrated in FIG. 7.

FIG. 10 is a timing diagram illustrating the time at which the organic light emitting display device according to an exemplary embodiment of the present invention is operated with the drive mode frame ratio as illustrated in FIG. 9, to express the pixel having the first exemplary color coordinate P1 illustrated in FIG. 7.

Figure 11:
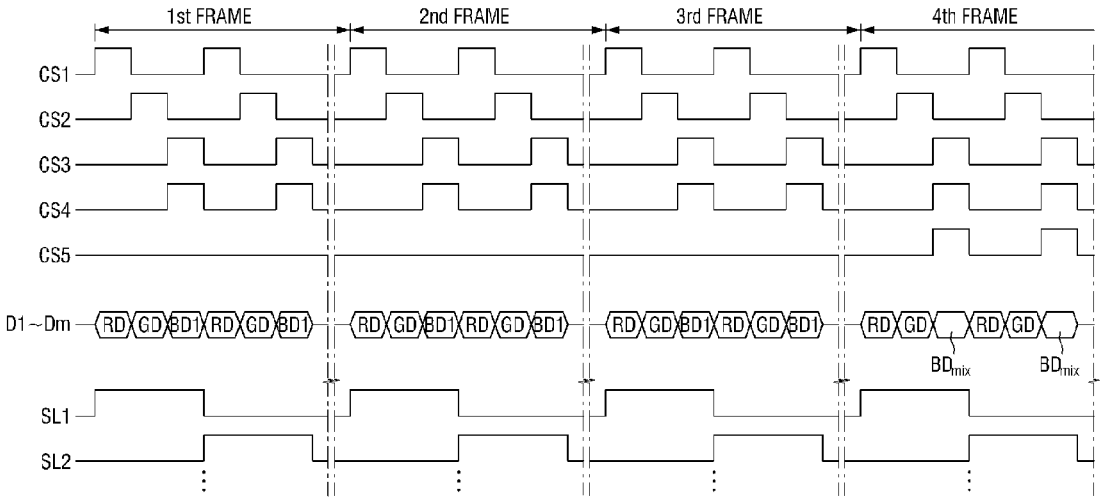
FIG. 11 is a timing diagram illustrating the time at which the organic light emitting display device according to an exemplary embodiment of the present invention is operated with a drive mode frame ratio as illustrated in FIG. 9, to express the pixels having the second exemplary color coordinate illustrated in FIG. 7.

FIG. 11 is a timing diagram illustrating the time at which the organic light emitting display device according to an exemplary embodiment of the present invention operates with the drive mode frame ratio as illustrated in FIG. 9, to express the pixel having the second exemplary color coordinate P2 illustrated in FIG. 7.

Figure 12:
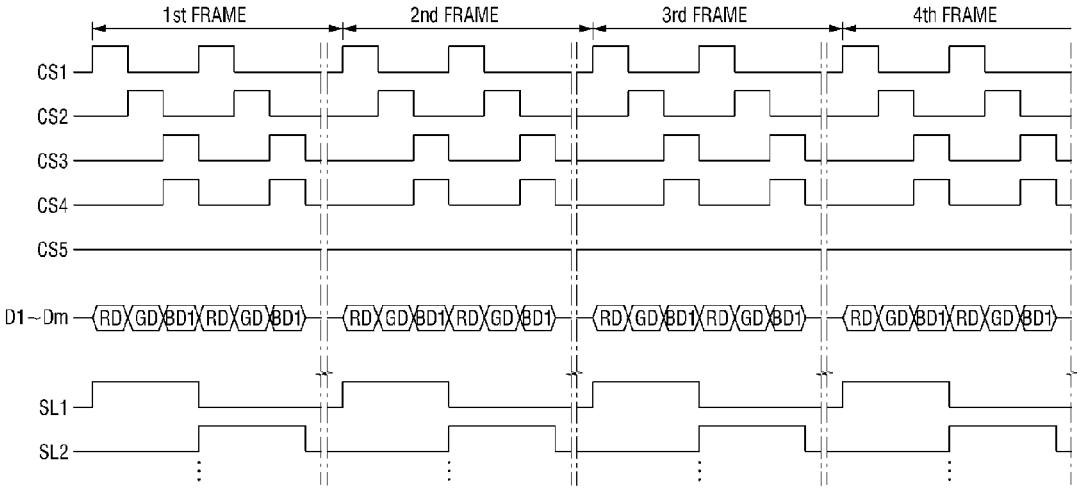
FIG. 12 is a timing diagram illustrating the time at which the organic light emitting display device according to an exemplary embodiment of the present invention is operated with a drive mode frame ratio as illustrated in FIG. 9, to express the pixels having the third exemplary color coordinate illustrated in FIG. 7.

FIG. 12 is a timing diagram illustrating the time at which the organic light emitting display device according to an exemplary embodiment of the present invention is operated with the drive mode frame ratio as illustrated in FIG. 9, to express the pixel having the third exemplary color coordinate P3 illustrated in FIG. 7.

Referring to FIG. 10, FIG. 11, and FIG. 12, the data output signals (D01 to D0*m*/4) applied to the de-multiplexer circuit 150 may include the red data signal RD, the green data signal GD sequentially applied by being divided temporally, and one of the first blue data signals BD1, the mixed blue data signal BDmix, and the second blue data signals BD2.

After the red data signal RD and the green data signal GD are sequentially applied, a turn-on signal may be applied to each scan line during a first interval of the data output signals (D01 to D0*m*/4) in which one of the first the blue data BD1, the mixed blue data BDmix, and the second blue data BD2 is applied.

Each of the red selection signal CS1 and the green selection signal CS2 is synchronized with the red data signal RD and the green data signal GD, respectively, and may maintain the turn-on signal state during the interval applied to the red data signal RD and the green data signal GD.

The blue selection signal CS3 may maintain the turn-on signal state, while the first blue data signals BD1, the mixed blue data signal BDmix, or the second blue data signal BD2 is applied.

During the frame when the organic light emitting display device operates in the first blue drive mode, the blue selection signal CS3 and the first blue selection signal CS4 may maintain the turn-on signal state. During the frame when the organic light emitting display device operates in the mixed drive mode, the blue selection signal CS3, the first blue selection signal CS4, and the second blue selection signal CS5 may maintain the turn-on signal state. During the frame when the organic light emitting display device operates in the second blue drive mode, the blue selection signal CS3 and the second blue selection signal CS5 may maintain the turn-on signal state.

Referring to FIG. 10, the timing diagram when the number of frames operating in the mixed drive mode to the number of frames operating in the second drive mode are in the ratio of one to one in order, to reproduce the color of the pixel having the color of the first exemplary color coordinate P1 in the image data including the first exemplary color coordinate P1.

Specifically, in the first frame and the third frame, the second blue data signal BD2 is applied to the data line, and in the second frame and the fourth frame, the mixed blue data signal BDmix is applied to the data line. Thus, the number of frames operating in the second blue drive mode and the number of frames operating in the mixed drive mode may have a one to one ratio.

FIG. 10 illustrates that the different drive modes may repeated alternately on the basis of one frame, however, according to an exemplary embodiment of the present invention, the different drive modes may be repeated in the unit of the multiple frames within the range corresponding to the drive mode frame ratio.

FIG. 11 is a timing diagram when the number of frames operating in the first drive mode and the number of frames operating in the mixed drive mode are in the ratio of three to one, to reproduce the color of the pixel having the color of the second exemplary color coordinate P2 in the image data including the second exemplary color coordinate P2.

Specifically, in the first frame to the third frame, the first blue data signal BD1 is applied to the data line, and in the fourth frame, the mixed blue data signal BDmix is applied to the data line. Thus, the number of frames operating in the first blue drive mode and the number of frames operating in the mixed drive mode have the ratio of three to one.

FIG. 12 is a timing diagram when the organic light emitting display device operates only in the first drive mode, to reproduce the color of the pixel having the color of the third exemplary color coordinate P3 in the image data including the third exemplary color coordinate P3.

Specifically, in every frame, the first blue data signal BD1 is applied to the data line.

Next, the operation of the image data correction unit 610 correcting the image data to match the mixed drive mode or the second blue drive mode will be described in detail with reference to FIG. 13.

Figure 13:
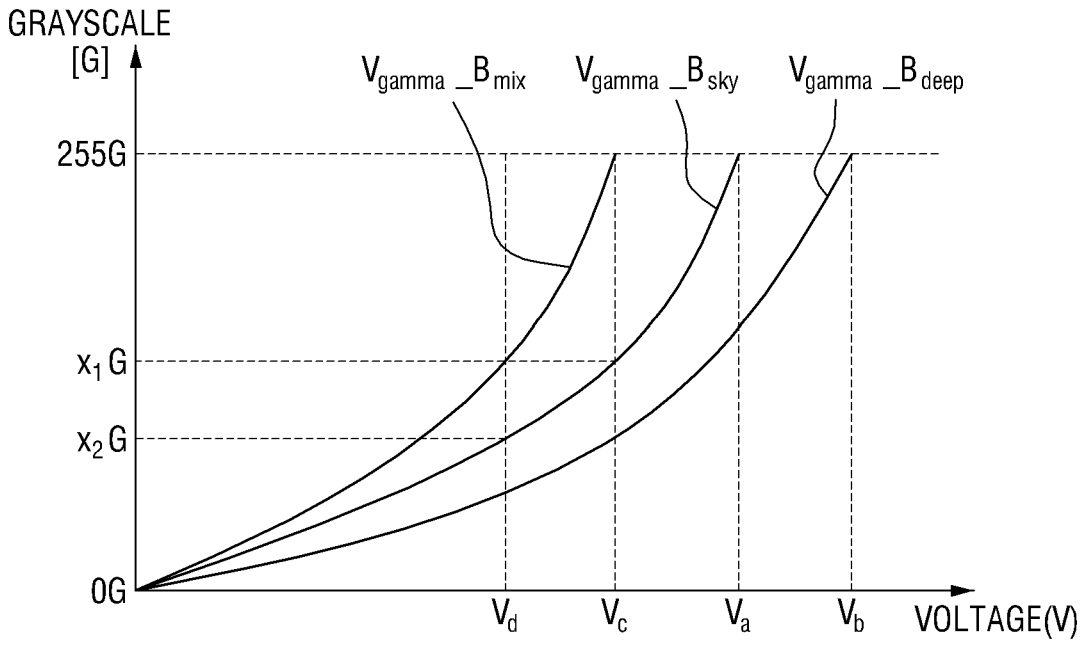
FIG. 13 is a graph illustrating a voltage versus grayscale curve of the first blue drive mode, the second blue drive mode, and the mixed drive mode.

FIG. 13 is graph illustrating a voltage versus grayscale curve of the first blue drive mode, the mixed drive mode, and the second blue drive mode.

Referring to FIG. 13, the first blue gamma curve Vgamma_Bsky is a curve illustrating the grayscale versus voltage when only the first blue sub-pixel B1 emits light in the first blue drive mode. The second blue gamma curve Vgamma_Bdeep is a curve illustrating the grayscale versus voltage when only the second blue sub-pixel B2 emits light in the second blue drive mode. The mixed blue gamma curve Vgamma_Bmix is a curve illustrating the grayscale versus voltage when both the first blue sub-pixel B1 and the second blue sub-pixel B2 emit light in the mixed drive mode.

In general, the first blue sub-pixel B1 emitting sky blue light may have higher luminous efficiency as compared to the second blue sub-pixel B2 emitting deep blue light. More particularly, when the same voltage is applied to the first blue sub-pixel B1 and the second blue sub-pixel B2, the first blue sub-pixel B1 may emit light of higher brightness or grayscale.

As illustrated in FIG. 13, the voltage Va of which the first blue sub-pixel B1 emits light with maximum brightness or grayscale 255G may be lower than the voltage Vb of which the second blue sub-pixel B2 emits light with maximum brightness or grayscale 255G.

In the frame operating in the mixed drive mode, if the light emitting area of the first blue sub-pixel B1 and the second blue sub-pixel B2 is the same as one of the first blue sub-pixel B1 or the second blue sub-pixel B2, the mixed blue gamma curve Vgamma_Bmix may be located in an intermediate area of the first blue gamma curve Vgamma_Bsky and the second blue gamma curve Vgamma_Bdeep.

However, in the organic light emitting display according to an exemplary embodiment of the present invention, since the mixed drive mode allows both the first blue sub-pixel B1 and the second blue sub-pixel B2 to emit light, an area that emits light in one pixel, i.e., four sub-pixels in the mixed drive mode, may be the sum of the areas of the first blue sub-pixel B1 and the second blue sub-pixel B2, and the mixed blue gamma curve Vgamma_Bmix may be located on the left side compared to the first blue gamma curve Vgamma_Bsky.

More particularly, in the first blue drive mode, the voltage Va of which the first blue sub-pixel B1 emits light with maximum brightness or grayscale 255G may be greater than the voltage Vc of which all of the first blue sub-pixel B1 and the second blue sub-pixel B2 emit light at maximum brightness in the mixed drive mode, to express the maximum grayscale 255G.

For example, the voltage Vc to express the maximum grayscale 255G in the mixed drive mode may correspond to the first grayscale value xG that is lower than the maximum grayscale 255G in the first blue gamma curve Vgamma_Bsky.

In an exemplary embodiment of the present invention, the grayscale voltage generation unit 170 may provide the data drive unit 140 with grayscale voltages (V0 to V255) corresponding to the first blue gamma curve Vgamma_Bsky, and the data drive unit 140 may select a part of the grayscale voltages (V0 to V255) corresponding to the first blue gamma curve Vgamma_Bsky depending on the input image signal, and supply the selected grayscale voltages (V0 to V255) to the de-multiplexer circuit 150 as the data output signals (D01 to D0*m*/4).

More particularly, when operating in the first blue drive mode, for any pixel with image data having the first grayscale value xG, the data drive unit 140 may select voltage Vc as the data output signals (D01 to D0*m*/4) and allow the first blue sub-pixel B1 to emit light with brightness corresponding to the first grayscale value xG.

However, when operating in the mixed drive mode, for any pixel with image data having a first grayscale value xG, if the grayscale voltage generation unit 170 provides the data drive unit 140 with the grayscale voltages (V0 to V255) corresponding to the first blue gamma curve Vgamma_Bsky, the data drive unit 140 may select the voltage Vc as the data output signals (D01 to D0*m*/4), and the first blue sub-pixel B1 and the second blue sub-pixel B2 may emit light with brightness corresponding to the maximum grayscale 255G.

In order to express the first grayscale xG without changing the grayscale voltages (V0 to V255) generated by the grayscale voltage generation section 170 in the frame operating in the mixed drive mode, the image data correction unit 610 may correct the image data of the frame operating in the mixed drive mode with reference to the first blue gamma curve Vgamma_Bsky and the mixed blue gamma curve Vgamma_Bmix.

For example, in order to express one pixel having the first grayscale value x1G in the frame operating in the mixed drive mode, the image data having the first grayscale value x1G may be corrected to the image data having the second grayscale value x2G in the frame operating in the mixed drive mode, by identifying a second grayscale value x2G on the first blue gamma curve Vgamma_Bsky that corresponds to the first grayscale value x1G in the mixed blue gamma curve Vgamma-Bmix.

For similar reasons, when operating in the second blue drive mode, if the grayscale voltage generation unit 170 generates grayscale voltages (V0 to V255) corresponding to the first blue gamma curve Vgamma_Bsky, the image data of the frame operating in the second blue drive mode may be corrected to match the first blue gamma curve Vgamma_Bsky.

In other words, the image data correction unit 610 may correct the image data of the frame operating in the mixed drive mode or the frame operating in the second blue drive mode, to match the first blue gamma curve Vgamma_Bsky. For example, such a correction may be performed by a calculation formula based on the curve equation of the first blue gamma curve Vgamma_Bsky and the mixed blue gamma curve Vgamma_Bmix, the curve equation of the first blue gamma curve Vgamma_Bsky and the second blue gamma curve Vgamma_Bdeep, or by referring to the conversion lookup table stored in the memory 126.

Figure 14:
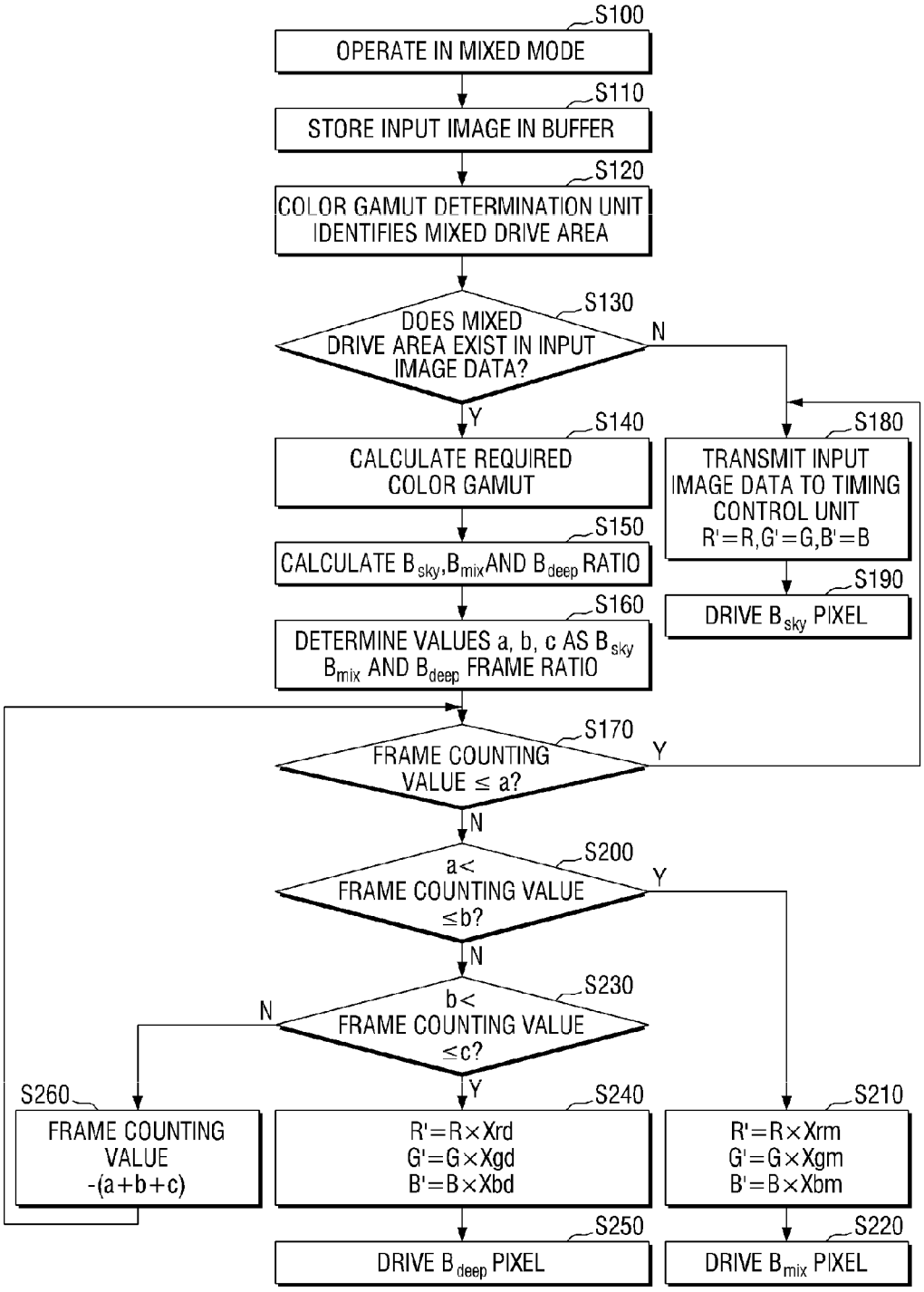
FIG. 14 is a flowchart illustrating a driving method of the organic light emitting display device according to an exemplary embodiment of the present invention.

FIG. 14 is a flowchart illustrating a driving method of an organic light emitting display device according to an exemplary embodiment of the present invention.

The flowchart illustrated in FIG. 14 will be schematically described in stages based on the driving method of the organic light emitting display device according to an exemplary embodiment of the present invention.

Referring to FIG. 14, in step S100, the organic light emitting display device may start operating in the "mixed mode" by a user or depending on specific conditions.

More particularly, the organic light emitting display device according to an exemplary embodiment of the present invention may be operated in a sky blue mode that is driven only by the first blue sub-pixel B1 for image data of all frames, in a deep blue mode that is driven only by the second blue sub-pixel B2 for the image data of all frames, and in a mixed mode that may drive the first blue sub-pixel B1, the second blue sub-pixel B2, or all of the first blue sub-pixel B1 and the second blue sub-pixel B2 in the unit of frame.

Sky blue light emitted from the first blue sub-pixel B1 may suppress melatonin that induces sleep of the viewer and promote serotonin that induces arousal of the viewer. Meanwhile, the deep blue light emitted from the second blue sub-pixel B2 may promote melatonin that induces sleep of the viewer and suppress serotonin that induces arousal of the viewer.

Therefore, the organic light emitting display device according to an exemplary embodiment of the present invention may be operated in the sky blue mode in daytime which may require relatively high brightness due to bright light surrounding the display device, and in the deep blue mode in nighttime which may not require high brightness due to relatively dark surrounding light of the display device and require sleep induction.

The organic light emitting display device according to an exemplary embodiment of the present invention may also operate in the "mixed mode" to improve color reproducibility, long useful life, and high energy efficiency, if the user or viewer does not require biological function of sky blue or deep blue mode.

The mixed mode used herein may be different from the "mixed drive mode." Generally, operating in the "mixed mode" may implement "mixed drive mode."

Modes of the organic light emitting display device may be changed per user's preference or according to specific conditions, for example, according to a preset time value.

For convenience of description, the organic light emitting display device according to exemplary embodiments of the present invention are described to operate in the mixed mode, in which the first blue drive mode and the mixed drive mode are mixed with each other in the image data corresponding to at least one frame. Hereinafter, the driving method of the organic light emitting display device according to an exemplary embodiment of the present invention in the mixed mode will be described.

In step S110, the color gamut determination unit 620 may store the raw image data IMAGE provided to the buffer.

The buffer may be a temporary storage that exists in an integrated circuit that includes the color gamut determination unit 620, or may be an area assigned into the memory 126.

In step S120, the color gamut determination unit 620 may identify a mixed drive area.

Here, the mixed drive area refers to the pixel or an area in the raw image data that includes the color of the second color gamut A2 or the third color gamut A3.

More specifically, the color gamut determination unit 620 detects the image data corresponding to the first color gamut A1, the second color gamut A2, or the third color gamut A3 from the image data stored in the buffer, and identifies the area of the image data that corresponds the second color gamut A2 and the third color gamut A3 as the mixed drive area, based on information of the detected color gamuts.

In step S130, the color gamut determination unit 620 may determine whether the mixed drive area, which is an area of the image data corresponding to the second color gamut A2 or the third color gamut A3, exists in the input image data stored in the buffer.

If the mixed drive area exists in the input image data, in step S140, the color gamut determination unit 620 may calculate the color gamut required to reproduce the color of the mixed drive area. For example, the color gamut required to reproduce the color of the mixed drive area may be calculated by calculating the average color coordinate value of the image data corresponding to the mixed drive area, or by setting the color coordinate value of the image data that requires the color reproduction, among the image data corresponding to the mixed drive area, as the color gamut value.

In step S150, based on the color gamut required for the calculated or set color reproduction, the color gamut determination unit 620 may calculate the drive mode frame ratio, which is a ratio of a number of frames for each of the first blue drive mode driving the first blue sub-pixel B1 that emits sky blue Bsky light, the second blue drive mode driving the second blue sub-pixel B2 that emits deep blue Bdeep light, and the mixed drive mode driving both the first blue sub-pixel B1 and the second blue sub-pixel B2.

In step S160, based on the calculated drive mode frame ratio, the color gamut determination unit 620 may determine values (a, b, c) corresponding to the number of frames of the first blue drive mode, the number of frames of the mixed drive mode, the number of frames of the second blue drive mode, respectively.

In step S170, it is determined whether the frame counting value of the number of frames displayed is smaller than or equal to value "a" that corresponds to the number of frames of the first blue drive mode.

In step S180, if the frame counting value is smaller than or equal to the value "a", or if the mixed drive area does not exist in the input image data in step S130, the input image signal is transmitted to the timing control unit without correction. In step S190, the first blue sub-pixel B1 that emits the sky blue Bsky light is driven by the first blue mode for the corresponding frame.

If the frame counting value is greater than the value "a", then in step S200, it is determined whether the frame counting value is greater than the value "a" and smaller than or equal to a value "b" that corresponds to the number of frames of the mixed drive mode.

In step 210, if the frame counting value is greater than the value "a" and is smaller than or equal to the value "b", the image data of the frame operating in the mixed drive mode is corrected to match the first blue gamma curve Bgamma_Bsky. In step S220, the frame is operated in the mixed drive mode in which both the first blue sub-pixel B1 and the second blue sub-pixel B2 emit light.

If the frame counting value is greater than the value "a" and is not smaller than or equal to the value "b" in step S200, then in step S230, it is determined whether the frame counting value is greater than the value "b" and is smaller than or equal to a value "c" that corresponds to the number of frames operating in the second blue drive mode.

If the frame counting value is greater than the value "b" and is smaller than or equal to the value "c", the image data of the frame operating in the second blue drive mode is corrected to match the first blue gamma curve Vgamma_Bsky (S240). In step S250, the frame is operated in the second blue drive mode in which the second blue sub-pixel B2 emits light.

In step 260, if the frame counting value is greater than the value "b" and is not smaller than or equal to the value "c" in step S230, a value obtained by adding all the values (a, b, c) is subtracted from the frame counting value, and the process returns to step S170.

Figure 15:
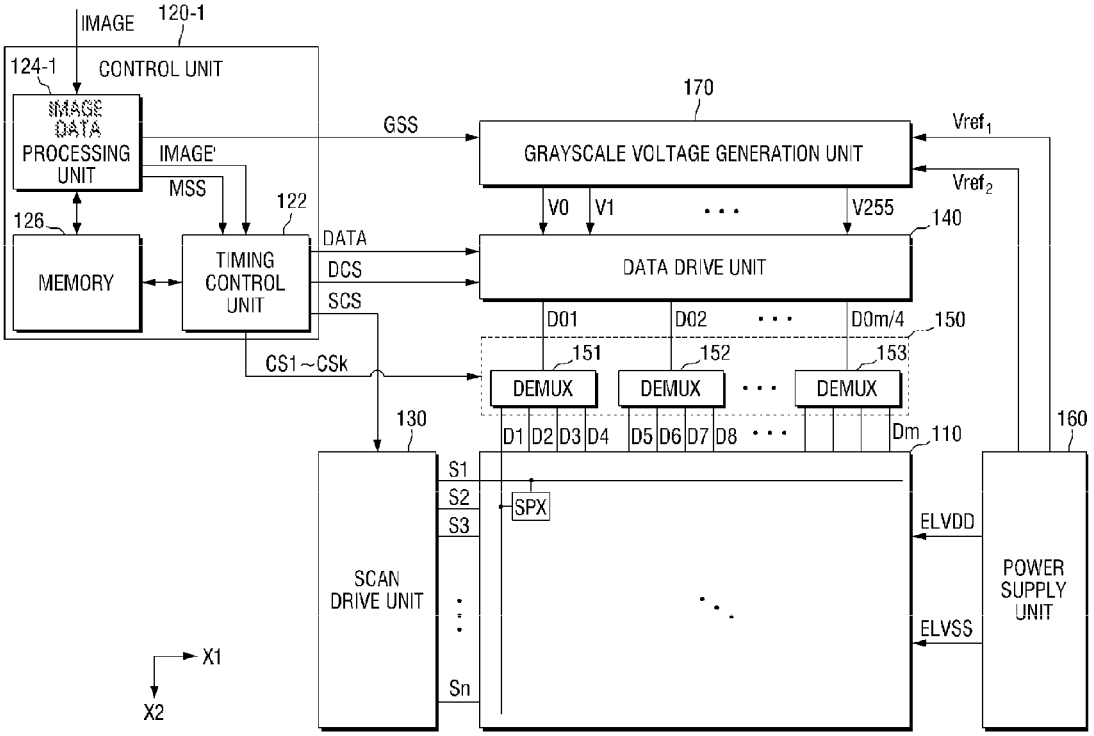
FIG. 15 is a block diagram schematically illustrating an organic light emitting display device according to an exemplary embodiment of the present invention.

FIG. 15 is a block diagram schematically illustrating an organic light emitting display device according to an exemplary embodiment of the present invention.

In FIG. 15, substantially similar constituent elements as those of the organic light emitting display device illustrated with reference to FIG. 1 are denoted by the same reference numerals, and the repetitive description thereof will be omitted. Hereinafter, differences between the organic light emitting display device illustrated in FIG. 1 and the organic light emitting display device according to the present exemplary will be mainly described.

Referring to FIG. 15, the organic light emitting display device further includes a display panel 110, a control unit 120-1, a scan drive unit 130, a data drive unit 140, a de-multiplexer circuit 150, a power supply unit 160, and a grayscale voltage generation unit 170.

According to the organic light emitting display device illustrated in FIG. 15, an image data processing unit 124-1 transmits the grayscale selection signal GSS to the grayscale voltage generation unit 170 to change the grayscale voltages (V0 to V255) of the grayscale voltage generation unit 170. Accordingly, when the image data corresponding to the frame operating in the second blue drive mode or the mixed drive mode is displayed, the desired grayscale may be expressed by changing the grayscale voltages (V0 to V255) to correspond to the second blue gamma curve Vgamma_deep or the mixed blue gamma curve Vgamma_Bmix, without correction of the image data of the frames operating in the second blue drive mode or the mixed the drive mode.

Next, the image data processing unit according to an exemplary embodiment of the present invention will be described in more detail with reference to FIG. 16.

Figure 16:
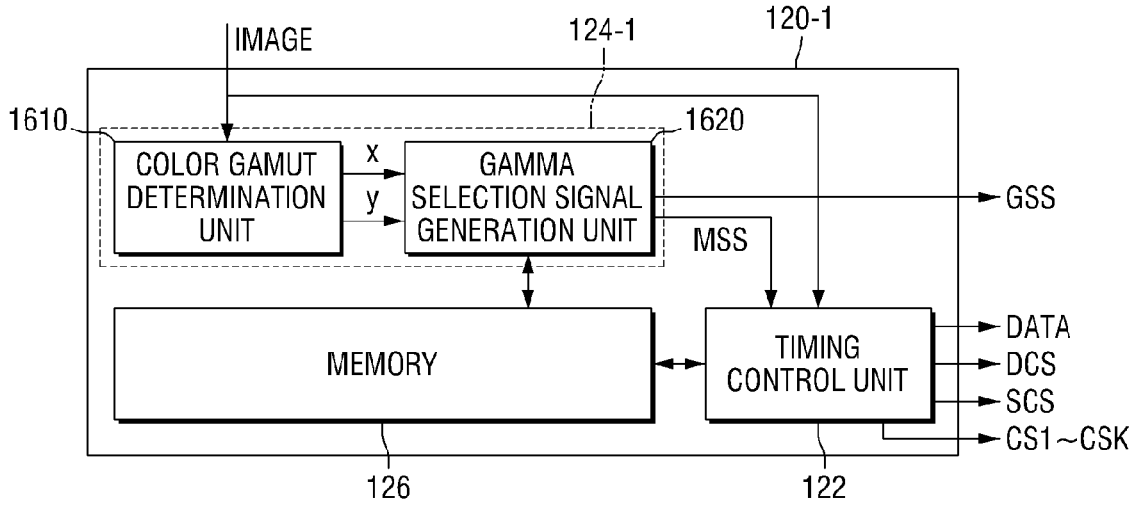
FIG. 16 is a block diagram schematically illustrating an image data processing unit according to an exemplary embodiment of the present invention.

FIG. 16 is a block diagram schematically illustrating an image data processing unit according to an exemplary embodiment of the present invention.

Referring to FIG. 16, the image data processing unit 124-1 includes a color gamut determination unit 1610 and a gamma selection signal generation unit 1620.

Since the color gamut determination unit 1610 of the image data processing unit 124-1 according to an exemplary embodiment of the present invention performs substantially similar function as that of the color gamut determination unit 620 of the image data processing unit 124 illustrated with respect to FIG. 6, the repeated description thereof will be omitted.

The gamma selection signal generation unit 1620 may receive the position values (x, y) of the pixel corresponding to the second color gamut A2 or the third color gamut A3 in the raw image data IMAGE from the color gamut determination unit 1610, or the values of the drive mode frame ratio corresponding to the ratio of the number of frames operating in the first blue drive mode to the number of frames operating in the second blue drive mode to number of frames operating in the mixed drive mode. The gamma selection signal generation unit 1620 may provide the grayscale selection signal GSS to the grayscale voltage generation unit 170 so that the grayscale voltage generation unit 170 may generate grayscale voltages (V0 to V255) corresponding to the second blue gamma curve Vgamma_Bdeep or the mixed blue gamma curve Vgamma_Bmix in the frames operating in the second blue drive mode or in the frames operating in the mixed drive mode.

Also, the gamma selection signal generation unit 1620 may transmit the mode selection signal MSS, which indicates whether the image data of the current frame operates in the first blue drive mode, the mixed drive mode, or the second blue drive mode, to the timing control unit 122. The timing control unit 122 may transmit the drive selection signals (CS1 to CSk) corresponding to the received mode selection signal MSS to the de-multiplexer circuit 150.

More particularly, the image data processing unit 124-1 according to the present exemplary embodiment may cause the grayscale voltage generation unit 170 to generate the grayscale voltages (V0 to V255) that match the mixed drive mode, or the grayscale voltages (V0 to V255) that match the second blue drive mode, when the image data of the frame operating in the mixed drive mode or the image data of the frame operating in the second blue drive mode is displayed on the display panel 110, thereby allowing the display panel 110 to express the grayscale value corresponding to the mixed drive, without a separate image data correction.

Figure 17:
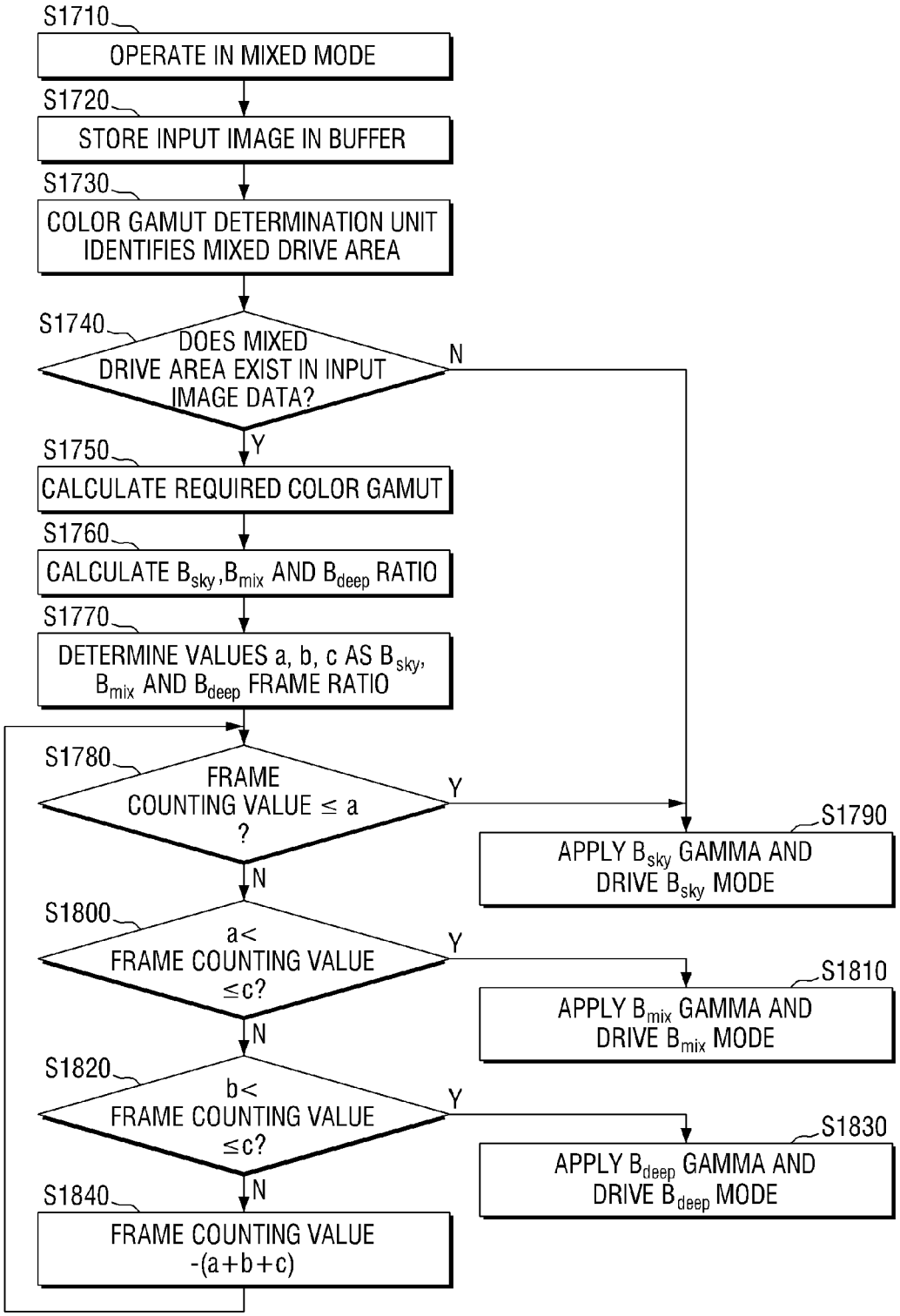
FIG. 17 is a flowchart illustrating a driving method of an organic light emitting display device according to an exemplary embodiment of the present invention.

FIG. 17 is a flowchart illustrating a driving method of an organic light emitting display device according to an exemplary embodiment of the present invention.

Referring to FIG. 17, in step S1710, the organic light emitting display device may operate in the "mixed mode" by a user or depending on specific conditions.

In step S1720, the color gamut determination unit 1610 may store the raw image data IMAGE provided to the buffer.

The buffer may be a temporary storage in the integrated circuit including the color gamut determination unit 1610, or may be an area assigned in the memory 126.

In step S1730, the color gamut determination unit 1610 may identify the mixed drive area.

Here, the mixed drive area refers to the pixel having the color of the second color gamut A2 or the third color gamut A3 in the raw image data or in an area of the image data.

More specifically, the color gamut determination unit 1610 may detect the image data corresponding to the first color gamut A1, the second color gamut A2, or the third color gamut A3 from the image data stored in the buffer, and identify the area of the image data that corresponds to the second color gamut A2 and the third color gamut A3 as the mixed drive area, based on information on the detected color gamuts.

In step S1740, the color gamut determination unit 1610 determines whether a mixed drive area that corresponds to the second color gamut A2 or the third color gamut A3 exists in the input image data stored in the buffer.

In step S1740, if the mixed drive area exists in the input image data, the color gamut determination unit 1610 determines whether the image corresponding to the enabled scan line is an image corresponding to the mixed drive area.

In step S1750, when the mixed drive area exists in the input image data, the color gamut determination unit 1610 may calculate the color gamut required to reproduce the color of the mixed drive area. For example, the color gamut required to reproduce the color of the mixed drive area may be calculated by calculating the average color coordinate value of the image data corresponding to the mixed drive area, or by setting the color coordinate value that requires color reproduction in the image data corresponding to the mixed drive area as the color gamut value.

In step S1760, based on the calculated or set color gamut, the color gamut determination unit 1610 may calculate the drive mode frame ratio, which is a ratio of a number of frames for each of the first blue drive mode driving the first blue sub-pixel B1 that emits sky blue Bsky light, the second blue drive mode driving the second blue sub-pixel B2 that emits deep blue Bdeep light, and the mixed drive mode driving both the first blue sub-pixel B1 and the second blue sub-pixel B2.

In step S1770, based on the calculated drive mode frame ratio, the color gamut determination unit 1610 may determine values (a, b, c) corresponding the number of frames of the first blue drive mode, the number of frames of the mixed drive mode, the number of frames of the second blue drive mode, respectively.

In step 1780, it is determined whether the frame counting value of the number of frames displayed is smaller than or equal to a value "a" that corresponds to the number of frames of the first blue drive mode If the frame counting value is smaller than or equal to the value "a", or if the mixed drive area does not exist in the input image data in step S1740, then in step S1790, the gamma selection signal generation unit 1620 may provide the first blue gamma selection signal as a grayscale selection signal GSS to the grayscale voltage generation unit 170 so that the grayscale voltage generation unit 170 may generate grayscale voltages (V0 to V255) corresponding to the first blue gamma curve Vgamma_Bsky, and the device operates in the first blue drive mode that drives the first blue sub-pixel B1 that emits sky blue Bsky to the frame.

If the frame counting value is greater than the value "a", then in step S1800, it is determined whether the frame counting value is greater than the value "a" and smaller than or equal to a value "b" corresponding to the number of frames of the mixed drive mode.

If the frame counting value is greater than the value "a" and is smaller than or equal to the value "b", the in step S1810, the gamma selection signal generation unit 1620 may provide the mixed blue gamma selection signal as the grayscale selection signal GSS to the grayscale voltage generation unit 170 so that the grayscale voltage generation unit 170 may generate the grayscale voltages (V0 to V255) corresponding to the mixed blue gamma curve Vgamma_Bmix, and operates the frame in the mixed drive mode in which both the first blue sub pixel B1 and the second blue sub-pixel B2 emit light.

If the frame counting value is greater than the value "a" and is not smaller than or equal to the value "b" in step S1800, then in step S1820, the process identifies whether the frame counting value is greater than the value "b" and smaller than or equal to a value "c" corresponding to the number of frames operating in the second blue drive mode.

If the frame counting value is greater than the value "b" and is smaller than or equal to the value "c", then in step S1830, the gamma selection signal generation unit 1620 may provide the second blue gamma selection signal as the grayscale selection signal GSS to the grayscale voltage generation unit 170 so that the grayscale voltage generation unit 170 may generate the grayscale voltages (V0 to V255) corresponding to the second blue gamma curve Vgamma_Bdeep, and operates the frame in the mixed drive mode in which all the second blue sub-pixels B2 emit light.

If the frame counting value is greater than the value "b" and is not smaller than or equal to the value "c" in step S1820, the in step S1840, a value obtained by adding all the values (a, b, c) is subtracted from the frame counting value, and the process returns to step S1780.

Although certain exemplary embodiments and implementations have been described herein, other embodiments and modifications will be apparent from this description. Accordingly, the inventive concept is not limited to such exemplary embodiments, but rather to the broader scope of the presented claims and various obvious modifications and equivalent arrangements.

What is claimed is:

1. An organic light emitting display device, comprising:

a display panel comprising red sub-pixels, green sub-pixels, first blue sub-pixels, and second blue sub-pixels, each sub-pixel connected to scan lines and data lines;

a scan drive unit configured to sequentially apply scan signals to the scan lines;

a data drive unit configured to receive an image signal and output data output signals;

a de-multiplexer circuit configured to distribute data output signals to the data lines connected to the red sub-pixels, the green sub-pixels, and the first blue sub-pixels, in response to receiving a first blue drive selection signal, or distribute the data output signals to the data lines connected to the red sub-pixels, the green sub-pixels, the first blue sub-pixels, and the second blue sub-pixels, in response to receiving a mixed drive selection signal; and a control unit configured to process a raw image data into the image signal, provide the image signal to the data drive unit, and provide the first blue drive selection signal or the mixed drive selection signal to the de-multiplexer circuit in a frame unit of the raw image data, wherein the control unit is configured to detect an image data that corresponds to a first color gamut and a second color gamut from the raw image data, and adjust a ratio of a number of frames operating in a first blue drive mode that provides the first blue drive selection signal to the de-multiplexer circuit and a number of frames operating in a mixed drive mode that provides the mixed drive selection signal, based on the image data corresponding to the second color gamut.

2. The organic light emitting display device of claim 1, wherein the control unit comprises:

an image data processing unit configured to receive the raw image data and generate a corrected image data; and a timing control unit configured to receive the corrected image data from the image data processing unit and process the corrected image data into the image signal.

3. The organic light emitting display device of claim 2, wherein the image data processing unit comprises:

a color gamut determination unit configured to detect the image data that corresponds to the first color gamut and the second color gamut from the raw image data, and determine a drive mode frame ratio corresponding to the ratio of the number of frames operating in the first blue drive mode and the number of frames operating in the mixed drive mode, based on the image data corresponding to the second color gamut; and an image data correction unit configured to receive the drive mode frame ratio from the color gamut determination unit, and generate the corrected image data by correcting the image data of the frame operating in the mixed drive mode.

4. The organic light emitting display device of claim 3, wherein:

the image data correction unit is configured to transmit a mode selection signal to the timing control unit, the mode selection signal indicating whether a frame operates in the first blue drive mode or in the mixed drive mode; and the timing control unit is configured to transmit the first blue drive selection signal or the mixed drive selection signal to the de-multiplexer circuit, depending on the received mode selection signal.

5. The organic light emitting display device of claim 4, wherein the data drive unit is configured to:

receive grayscale voltages from a grayscale voltage generation unit;

select one or more of the received grayscale voltages; and output the selected grayscale voltages as the data output signals.

6. The organic light emitting display device of claim 5, wherein the grayscale voltage generation unit is configured to:

receive a grayscale voltage selection signal from the timing control unit; and generate the grayscale voltages that correspond to:

a gamma curve in the first blue drive mode that drives the red sub-pixels, the green sub-pixels, and the first blue sub-pixels; or a gamma curve in the mixed blue drive mode that drives the red sub-pixels, the green sub-pixels, the first blue sub-pixels, and the second blue sub-pixels, depending on the received grayscale voltage selection signal.

7. The organic light emitting display device of claim 6, wherein the image data correction unit is configured to correct the raw image data by matching the grayscale value of the image data of the frame operating in the mixed drive mode in the raw image data to the gamma curve in the first blue drive mode.

8. The organic light emitting display device of claim 7, wherein the control unit further comprises a memory configured to store a reference value with respect to the gamma curve in the first blue drive mode and the gamma curve in the mixed blue drive mode.

9. The organic light emitting display device of claim 1, further comprising a grayscale voltage generation unit configured to provide grayscale voltages to the data drive unit, wherein the data drive unit is configured to select one or more of the received grayscale voltages and provide the selected grayscale voltages to the de-multiplexer circuit as the data output signals.

10. The organic light emitting display device of claim 9, wherein the control unit comprises:

an image data processing unit configured to provide a grayscale voltage selection signal the grayscale voltage generation unit; and a timing control unit configured to receive the raw image data and process the raw image data into the image signal.

11. The organic light emitting display device of claim 10, wherein the image data processing unit comprises:

a color gamut determination unit configured to detect an image data that corresponds to the first color gamut and the second color gamut from the raw image data, and determine a drive mode frame ratio that corresponds to a ratio of a number of frames operating in the first blue drive mode and a number of frames operating in the mixed drive mode, based on the image data corresponding to the second color gamut; and a gamma selection signal generation unit configured to receive the drive mode frame ratio from the color gamut determination unit, provide a first gamma selection signal that corresponds to the first blue drive mode to the grayscale voltage generation unit for frames operating in the first blue drive mode, and provide a second gamma selection signal that corresponds to the mixed drive mode to the grayscale voltage generation unit for frames operating in the mixed drive mode.

12. The organic light emitting display device of claim 11, wherein:

the grayscale voltage generation unit generates a first grayscale voltages in response to the first gamma selection signal, the first grayscale voltages corresponding to a first gamma curve that corresponds to the grayscale value when the red sub-pixels, the green sub-pixels, and the first blue sub-pixels are driven; and the grayscale voltage generation unit generates a second grayscale voltages in response to the second gamma selection signal, the second grayscale voltages corresponding to a second gamma curve that corresponds to the grayscale value when the red sub-pixels, the green sub-pixels, first blue sub-pixels, and the second blue sub-pixels are driven.

13. The organic light emitting display device of claim 11, wherein:

an image data correction unit of the image data processing unit is configured to transmit a mode selection signal to the timing control unit, the mode selection signal indicating whether the image data of the corrected image data corresponds to the first blue drive mode or the mixed drive mode; and the timing control unit is configured to transmit the first blue drive selection signal or the mixed blue drive selection signal to the de-multiplexer circuit, depending on the received mode selection signal.

14. The organic light emitting display device of claim 1, wherein a color of light emitted from the first blue sub-pixels is lighter than a color of light emitted from the second blue sub-pixels.

15. The organic light emitting display device of claim 1, wherein the data output signal applied to the de-multiplexer circuit comprises red data signal applied to the red sub-pixels, green data signal applied to the green sub-pixels, and blue data signal applied to the first blue sub-pixels, the second blue sub-pixels, or both the first blue sub-pixels and the second blue sub-pixels arranged sequentially.

16. The organic light emitting display device of claim 1, wherein:

the first color gamut comprises a color gamut expressed by light-emission of the red sub-pixels, the green sub-pixels, and the first blue sub-pixels; and the second color gamut comprises a color gamut expressed by light-emission of the red sub-pixels, the green sub-pixels, the first blue sub-pixels, and the second blue sub-pixels, excluding the first color gamut.

17. The organic light emitting display device of claim 1, when the raw image data comprises only the image data corresponding to the first color gamut, the organic light emitting display device is configured to operate in the first blue drive mode.

18. The organic light emitting display device of claim 1, when the raw image data comprises image data that corresponds to the first color gamut and the second color gamut, the ratio is adjusted to maximize the number of frames operating in the first blue drive mode to the extent that a color corresponding to the second color gamut is reproduced.

19. The organic light emitting display device of claim 1, wherein the control unit is configured to:

detect the image data corresponding to the first color gamut, the second color gamut, and a third color gamut from the image data; and adjust the ratio of the number of frames operating in the first blue drive mode that provides the first blue drive selection signal to the de-multiplexer circuit, the number of frames operating in the mixed drive mode that provides the mixed drive selection signal to the de-multiplexer circuit, to a number of frames operating in a second blue drive mode that provides a second blue drive selection signal to the de-multiplexer circuit, based on the image data belonging to the second color gamut and the third color gamut; and the third color gamut comprises color gamut different from the first color gamut and the second color gamut.

20. The organic light emitting display device of claim 19, wherein:

the first color gamut comprises a color gamut expressed by light-emission of the red sub-pixels, the green sub-pixels, and the first blue sub-pixels;

the second color gamut comprises a color gamut expressed by light-emission of the red sub-pixels, the green sub-pixels, the first blue sub-pixels, and the second blue sub-pixels, excluding the first color gamut; and the third color gamut comprises a color gamut expressed by light-emission of the red sub-pixels, the green sub-pixels, the first blue sub-pixels, and the second blue sub-pixels, excluding the first color gamut and the second color gamut.

* * * * *